US011002110B2

(12) United States Patent
Leiper et al.

(10) Patent No.: US 11,002,110 B2
(45) **Date of Patent: *May 11, 2021**

(54) DOWNHOLE MAGNET, DOWNHOLE MAGNETIC JETTING TOOL AND METHOD OF ATTACHMENT OF MAGNET PIECES TO THE TOOL BODY

(71) Applicant: Odfjell Well Services Norway AS, Tananger (NO)

(72) Inventors: Simon Leiper, Dubai (AE); Kevin Robertson, Insch Aberdeensir (GB)

(73) Assignee: Odfjell Well Services Norway AS, Tananger (NO)

( * ) Notice: Subject to any disclaimer, the term of this patent is extended or adjusted under 35 U.S.C. 154(b) by 0 days.

This patent is subject to a terminal disclaimer.

(21) Appl. No.: 16/693,957

(22) Filed: Nov. 25, 2019

(65) Prior Publication Data

US 2020/0165903 A1 May 28, 2020

Related U.S. Application Data

(63) Continuation of application No. 15/858,281, filed on Dec. 29, 2017, now Pat. No. 10,487,627, which is a continuation of application No. 14/842,423, filed on Sep. 1, 2015, now Pat. No. 9,863,219, which is a continuation of application No. 13/710,653, filed on Dec. 11, 2012, now Pat. No. 9,121,242.

(60) Provisional application No. 61/712,059, filed on Oct. 10, 2012.

(51) Int. Cl.

| | |
|---|---|
| ***E21B 31/06*** | (2006.01) |
| ***E21B 31/03*** | (2006.01) |
| ***E21B 37/00*** | (2006.01) |

(52) U.S. Cl.

CPC ..... *E21B 37/00* (2013.01); *E21B 31/06* (2013.01)

(58) Field of Classification Search

CPC ..... E21B 31/06; E21B 31/03; E21B 41/0078; E21B 37/00; E21B 31/035

See application file for complete search history.

(56) References Cited

U.S. PATENT DOCUMENTS

| | | | | |
|---|---|---|---|---|
| 9,121,242 | B2 * | 9/2015 | Leiper | E21B 37/00 |
| 9,863,219 | B2 * | 1/2018 | Leiper | E21B 37/00 |
| 10,487,627 | B2 * | 11/2019 | Leiper | E21B 31/06 |

* cited by examiner

*Primary Examiner* — Cathleen R Hutchins

(74) *Attorney, Agent, or Firm* — Roy Kiesel Ford Doody & North, APLC; Brett A. North

(57) ABSTRACT

A tool for suspending in a well retrieves various metal debris from the well, and includes an elongated tool body with a plurality of magnets included in a plurality longitudinal ridges which are circumferentially spaced. In the method a plurality of magnets can be positioned within openings, recesses, or pockets in each ridge, and held in place by one or more retaining plates, the tool being connected to a drill string and lowered into a well.

19 Claims, 35 Drawing Sheets

DOWNHOLE MAGNET, DOWNHOLE MAGNETIC JETTING TOOL AND METHOD OF ATTACHMENT OF MAGNET PIECES TO THE TOOL BODY

CROSS-REFERENCE TO RELATED APPLICATIONS

This is a continuation of U.S. patent application Ser. No. 15/858,281, filed Dec. 29, 2019 (issuing as U.S. Pat. No. 10,487,627 on Nov. 26, 2019), which is a continuation of U.S. patent application Ser. No. 14/842,423, filed Sep. 1, 2015 (now U.S. Pat. No. 9,863,219), which is a continuation of U.S. patent application Ser. No. 13/710,653, filed Dec. 11, 2012 (now U.S. Pat. No. 9,121,242), which claims the benefit of U.S. Provisional Patent Application Ser. No. 61/712,059, filed Oct. 10, 2012; each of which applications/patents are incorporated herein by reference and to/from each of which priority is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND

The practice of removal of debris from oil and gas wells is well documented and there are many examples of prior art which include scrapers and brushes to mechanically clean the interior casing of the well. Likewise there are examples of tools designed to remove the debris from the wellbore after it has been scraped and/or brushed. These include junk subs, debris filters, circulation tools, magnets and other similar tools. There also exists several examples of magnetic downhole tools.

There are also examples of tools designed to jet the Blow Out Preventers (BOPs), Wellhead and other cavities found in the wellbore. There also exists in prior art tools which combine the action of BOP jetting and magnetic attraction.

The present invention relates to wells for producing gas and oil and, more particularly, to wellbore cleaning tools, and more particularly, to magnetic wellbore cleaning tools which collect ferromagnetic materials suspended in wellbore fluid.

When drilling an oil or gas well, or when refurbishing an existing well, normal operations may result in various types of metal debris being introduced into the well. Downhole milling produces cuttings which often are not completely removed by circulation.

Other metallic objects may drop into and collect near the bottom of the well, or on intermediate plugs placed within the well.

Various drilling and cleaning operations in the oil and gas industry create debris that becomes trapped in a wellbore, including ferromagnetic debris. Generally, fluids are circulated in such a wellbore to washout debris before completion of the well. Several tools have been developed for the removal of ferromagnetic debris from a wellbore. There is a continuing need for a more effective magnetic wellbore cleaning tool.

In one embodiment the magnetic wellbore cleaning tool removes ferromagnetic debris from a wellbore wherein the tool body can be attached to a work string and lowered into a wellbore.

In one embodiment upper and a lower centralizers can be placed on the tool body.

In one embodiment the tool body can have a plurality of longitudinal ridges, each of the plurality of ridges having openings or recesses for holding magnets, wherein the magnets are circumferentially spaced about the body and are aligned in a parallel direction with respect to the longitudinal axis of the tool body.

In one embodiment one or more magnets can be held in place in the opening or recess by a retaining plate. In one embodiment the retaining plate can be slid into a locking position using a slot in a longitudinal ridge. In one embodiment the retaining plate can have one or more openings for exposing a portion of one or more magnets being retained in the opening or recess.

In one embodiment the retainer plate can have a quick lock/quick unlock system wherein in the locked stated the plate is held in place in the slot, and in the unlocked state the plate can slide out of the slot. In one embodiment the quick lock/quick unlock system can include a biased locking connector such as a grub screw.

In one embodiment the plurality of longitudinal ridges can be detachably connected to the tool body. In one embodiment the plurality of ridges can slidably connect to the tool body.

In one embodiment the tool body can include an longitudinal bore which is fluidly connected to the drill string bore, and include a plurality of jetting ports which are fluidly connected to the longitudinal bore of the tool body.

In one embodiment each longitudinal ridge can include at least one jetting nozzle, and in other embodiments can include a plurality of jetting nozzles.

In one embodiment the plurality of ridges when attached to the tool body can form an annular area, wherein the annular area is fluidly connected to the longitudinal bore of the tool body and at least one of the plurality of jetting nozzles.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF SUMMARY

The apparatus of the present invention solves the problems confronted in the art in a simple and straightforward manner. One embodiment provides an improved wellbore cleaning method and apparatus whereby wellbore cleanup tools performing the functions of a magnet cleanup tool.

One embodiment relates to a method of attachment of a magnet to a downhole magnetic tool, where the tool will be used for wellbore cleanup.

One embodiment includes a downhole magnet tool where the magnets are attached to an integral tool body.

One embodiment includes a downhole magnet tool where the magnets are attached to a removable sleeve which is mounted to an integral tool body One embodiment includes an integral tool body or sleeve on a tool body, the body having a interior longitudinal bore with fluidly connected radial ports passing through the magnetic section which ports can be used for jetting.

In one embodiment is provided a method of attaching commercially available magnetic strips to a customized tool body in a low cost and reliable manner whereby the magnets are securely attached to the tool, whereby the primary attachment method is backed up by one or more supplementary attachment methods to prevent accidental removal downhole.

In one embodiment a plurality of magnets can be attached to a tool body wherein the tool body is included as part of a drill string and magnets are attached to milled ribs running longitudinally along the tool body. In one embodiment the outside diameter of the plurality of ribs can be slightly less than the wellbore internal diameter, which centralizes the tool and maximized exposure of the magnetic surface of the magnets. In various embodiments the outside diameter of the ribs can be 99, 98, 97, 96, 95, 94, 93, 92, 91, 90, 89, 88, 87, 86, and/or 85 percent of the internal diameter of the wellbore. In various embodiments the outside diameter of the ribs can be a range between any two of the above specified percentages.

In one embodiment, the magnets can be attached to an externally mounted ribbed sleeve. In this embodiment the ribbed sleeve can also be used as a jetting sleeve which includes a plurality of jetting ports to selectively jet blow out preventers ("BOPs), wellheads, and/or risers as desired by the user. The BOP's, etc. are of larger internal diameter than the wellbore and the jetting sleeve can be sized to suit these larger diameters, typically 16" or 11" outer diameters.

In various embodiments, the plurality of magnets can be mounted on the tool in one of two fashions: (1) attached to longitudinal ribs, or (2) mounted between ribs facing radially outward from the longitudinal center of the tool body.

Various embodiments may include jetting ports drilled radially through one or more of the ribs, wherein the jetting ports can be used to clean the BOP, riser, and/or wellhead, and the magnets can be used to catch debris dislodged during the cleaning process, such as the jetting process. This is of additional benefit inside a riser which has a large internal diameter (e.g., 19-22") and where low circulation rates make circulation of debris to surface problematic, if not impossible.

One embodiment includes attaching the magnets by milling pockets into longitudinal ribs or milling tangential pockets into the external circumference between the longitudinal ribs. In one embodiment the magnets are inserted into elongated longitudinal pockets (wherein the magnets are rectangular in form), a magnet spacer can be used to hold the magnets in place and offset from other magnets and from the ferrous body or sleeve. In one embodiment a magnet retainer can next be inserted into a recessed slot which retains the magnets by overlapping a small portion around the edges of the magnet. The magnet retainer is prevented from being accidentally removed by including internally installed grub screws and springs which are backed out into mating internal slots on the magnet retainer. In one embodiment is provided bissell pins as a final method of security for securing the magnet retainer.

In one embodiment is provided a tool which can be suspended in a well to retrieve ferrous metal debris from the well. In one embodiment the tool can include an elongated tool body having a plurality of circumferentially arranged magnets in openings, pockets, or recesses. A plurality of magnets may be positioned in each opening, pocket, or recess, and one or more magnet retaining plates can be used for detachably securing the magnets in place.

In one embodiment the tool body can include a central bore for pumping fluid through the tool body and/or through one or more jetting nozzles located on the tool body, and the upper end of the tool body is configured for attaching to a tubular extending into the surface.

In one embodiment of the method, a tool body can be provided with a plurality of openings, pockets, or recessed slots as discussed above, and magnets are positioned within each slot and are held in place by one or more retaining plates which are detachably secured to the tool body. The tool with magnets may then be positioned in the well for collecting and subsequently retrieving metal debris.

In one embodiment the magnets can be held within the tool body, yet removed from the tool body during operations at an oil and gas drilling rig. In one embodiment the tool may be used and cleaned and repaired in a field operation at the drilling rig.

In one embodiment each of the plurality of magnets can be completely recessed in the tool body.

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIG. 56 is a sectional view of the ridge taken from section line 55--56 shown in

FIG. 54.

DETAILED DESCRIPTION

Unitary Body With Magnetized Ridges

Figure 1:
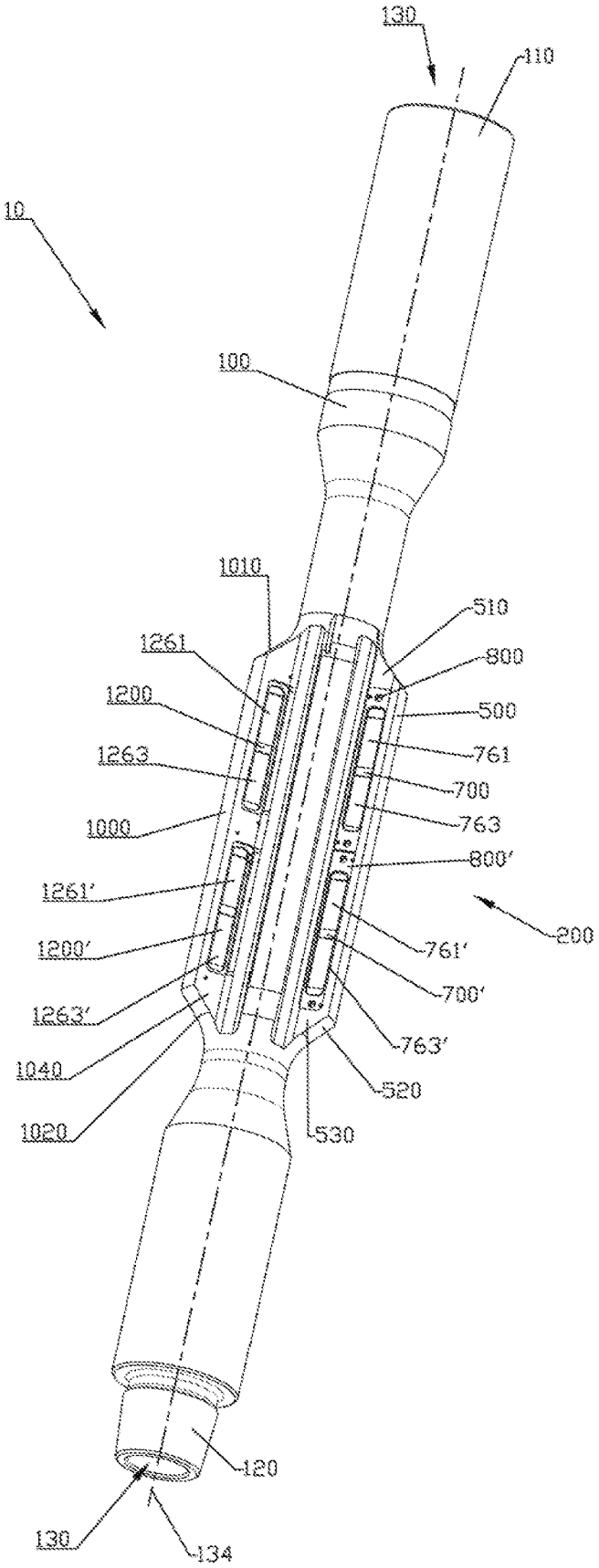
FIG. 1 is a perspective view of a first embodiment of a magnet tool having magnets in longitudinal ridges wherein the ridges have openings or pockets which extend through the ridges.
Figure 2:
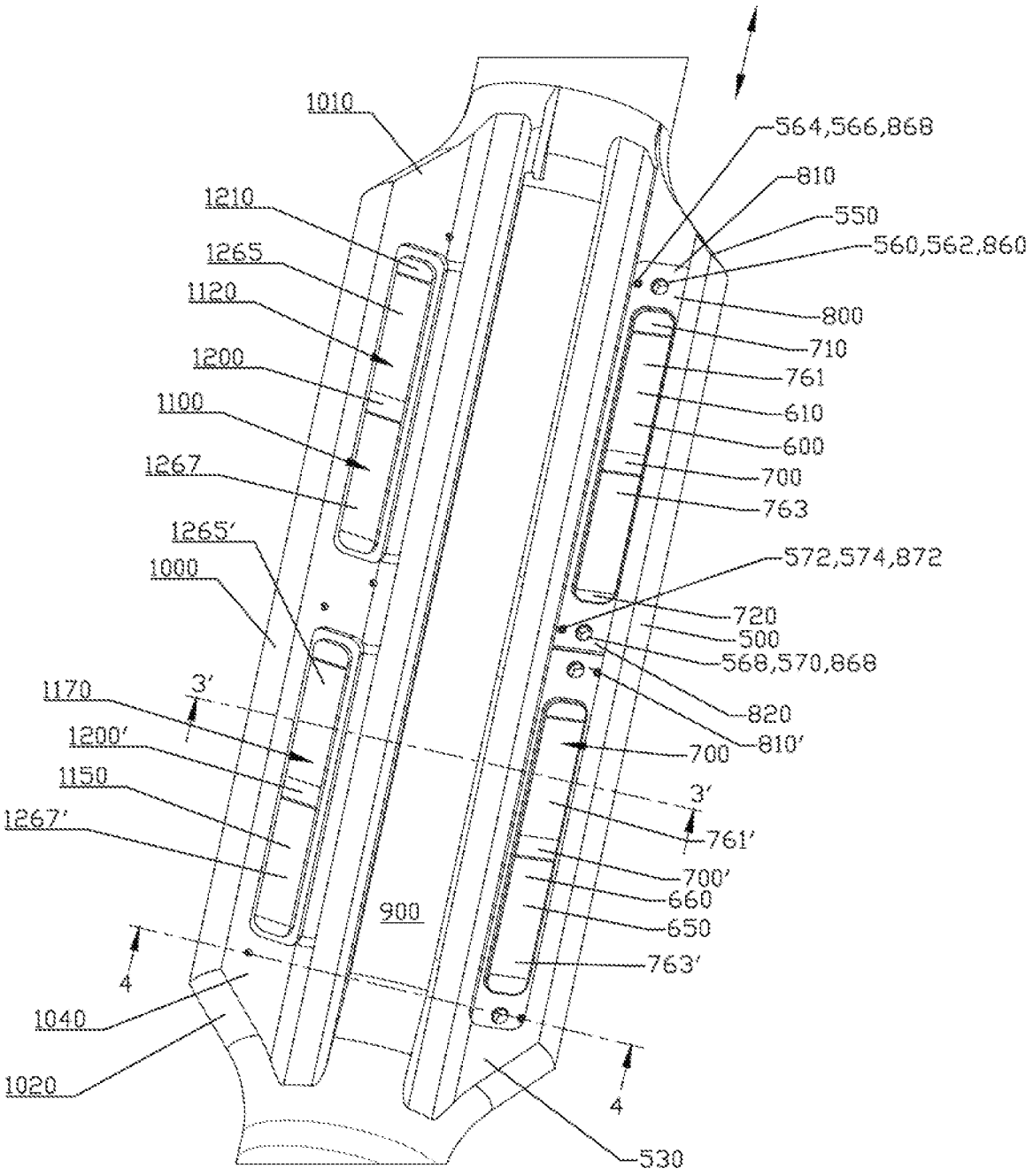
FIG. 2 is an enlarged perspective view of the ridge portion of the magnet tool of FIG. 1.
Figure 3:
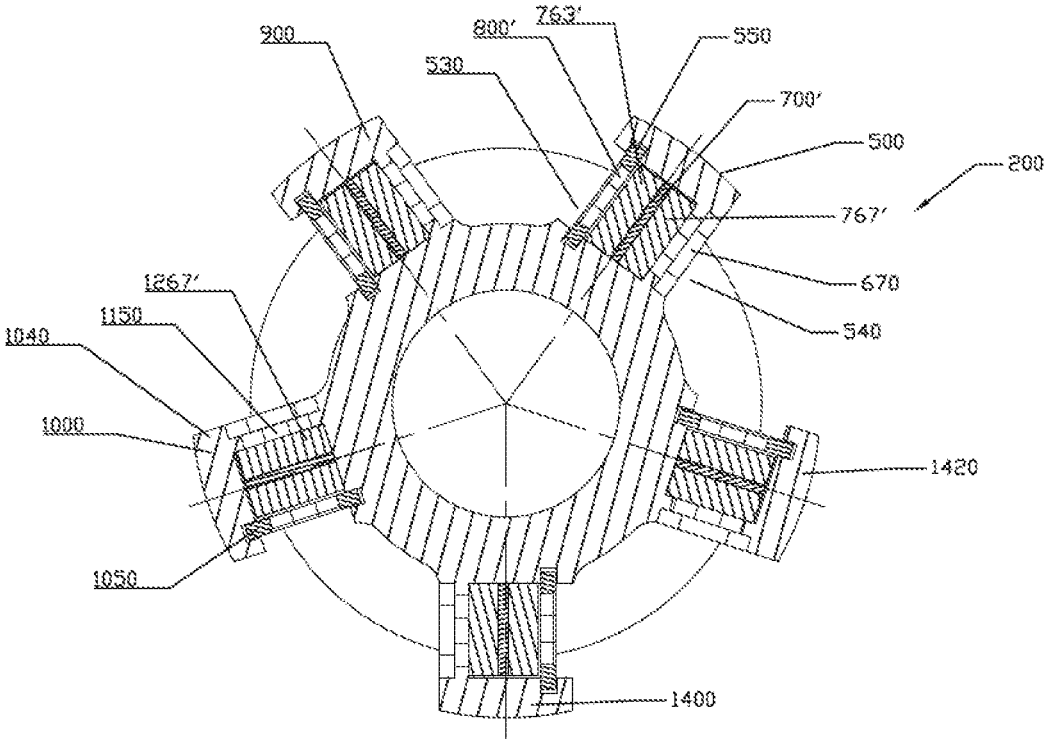
FIG. 3 is a sectional view of the magnet tool of FIG. 1 taken through the section line 3--3 of FIG. 2.
Figure 4:
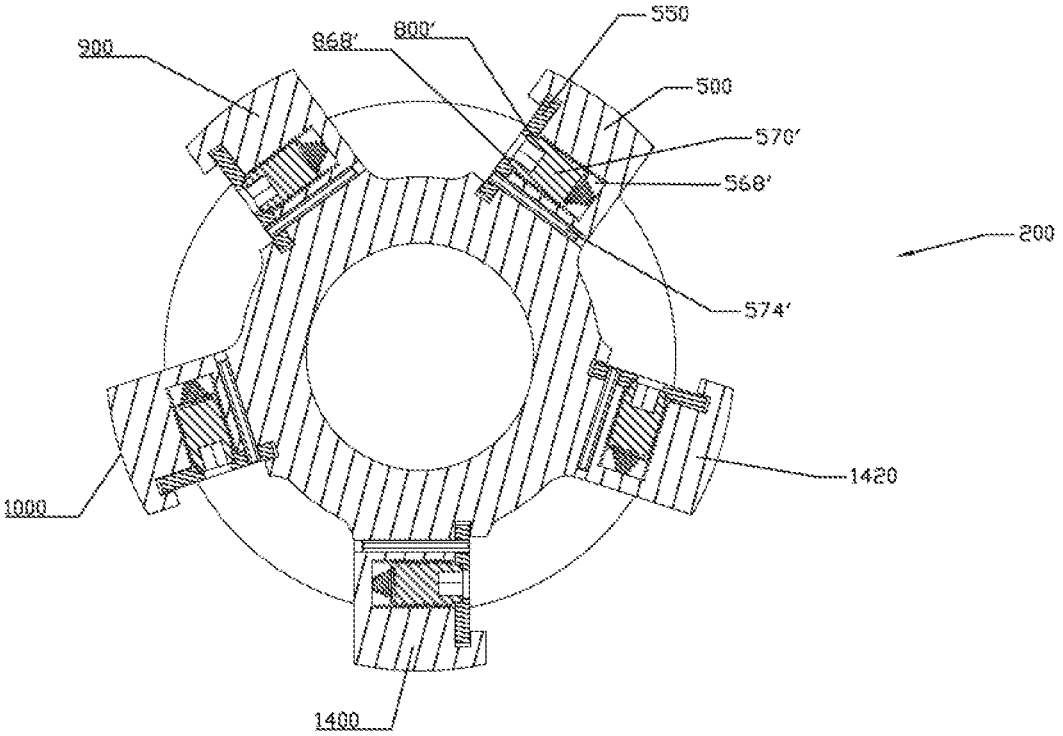
FIG. 4 is a sectional view of the magnet tool of FIG. 1 taken through the section line 4--4 of FIG. 1.
Figure 5:
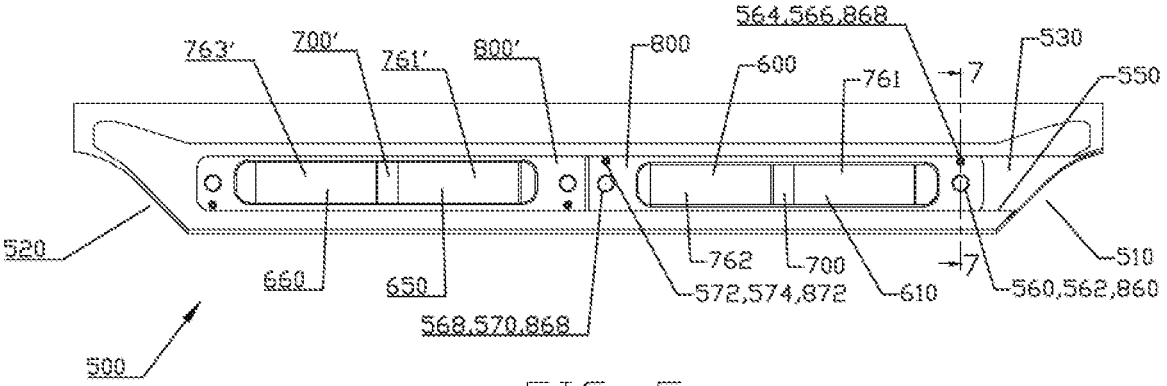
FIG. 5 is a side view of one of the ridges of the magnet tool of FIG. 1 viewed from the side of the ridge having the magnet retaining plate.
Figure 6:
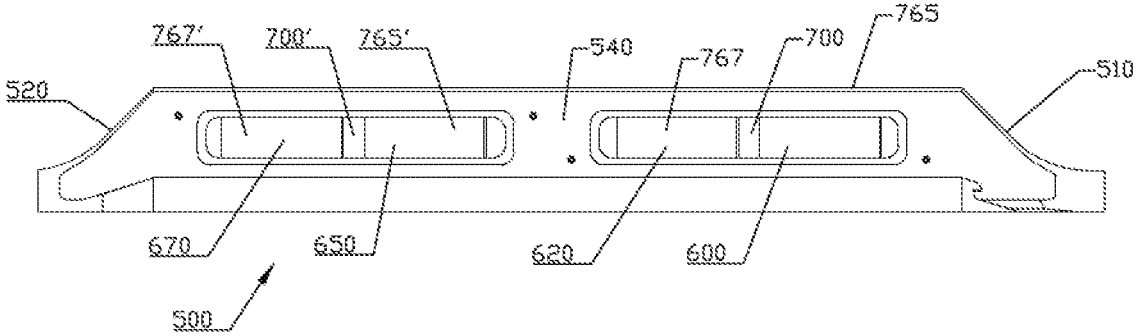
FIG. 6 is a side view of one of the ridges of the magnet tool of FIG. 1 viewed from the side of the ridge not having the magnet retaining plate.
Figure 7:
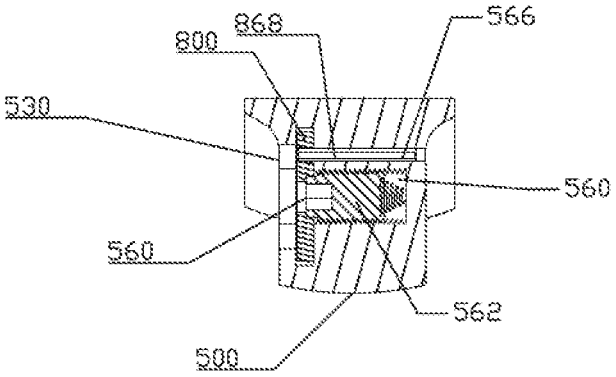
FIG. 7 is a sectional view of the ridge shown in FIG. 5 taken through the section line 7--7 of FIG. 5.

FIG. 1 shows a perspective view of one embodiment of magnetic tool 10 having magnets in a plurality of longitudinal ridges 200 wherein the magnetized ridges have openings or pockets which extend through the ridges. FIG. 2 is an enlarged perspective view of the plurality of ridges 200. FIG. 3 is a sectional view of the magnet tool 10 taken through the section line 3--3 of FIG. 1. FIG. 4 is a sectional view of the magnet tool 10 taken through the section line 4--4 of FIG. 1. FIG. 5 is a side view of magnetized ridge 500 viewed from side 530 (the side having magnet retaining plates 800,800'). FIG. 6 is a side view of magnetized ridge 500 viewed from side 540. FIG. 7 is a sectional view of magnetized ridge 500 taken through the section line 7--7 of FIG. 5.

Generally, magnetic tool 10 includes an elongated tool body 100 having a plurality of magnetized longitudinal ridges 200. Between pairs of magnetized ridges can be collection areas for ferrous debris.

Tool body 100 can include upper box end 110, lower pin end 120, central bore 130 running through tool body 100, and longitudinal axis 134. In one embodiment, upper end 110 can be configured for receiving a tubular for suspending the tool body in the well, and for passing fluid through central bore 130 in tool body 100. In other embodiments, tool 10 may be configured for connection to a wireline, or to another type of tubular for suspending the tool in the well.

In one embodiment tool body 100 can include ridges five magnetized longitudinal ridges (500, 900, 1000, 1400, and 1420) which are symmetrically spaced radially about longitudinal axis 134. In one embodiment the five longitudinal ridges can be equally radially spaced about 72 degrees apart. In various embodiments the individual ridges can be constructed substantially similar to each other. In varying embodiments a varying numbers of longitudinal ridges can be used including 3, 4, 5, 6, 7, 8, 9, 10, 11, 12, 13, 14, and 15. In different embodiments a range of ridges can be used which range varies between any two of the above specified number of ridges.

Figure 14:
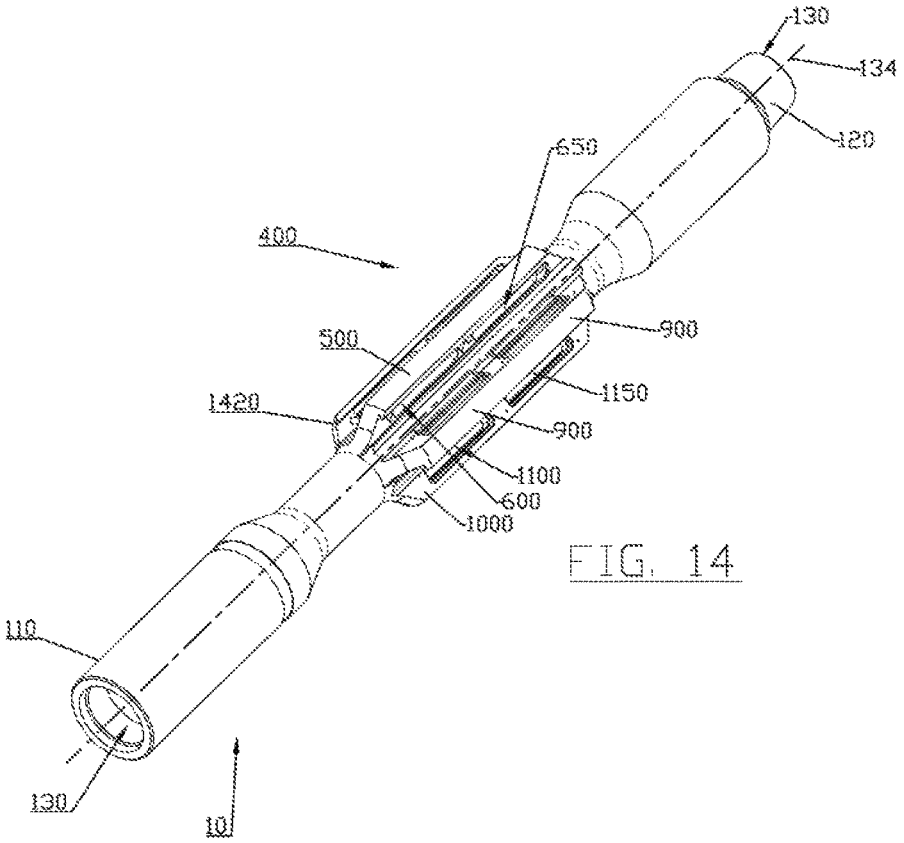
FIG. 14 is a perspective view of the body portion of the magnet tool of FIG. 1.
Figure 15:
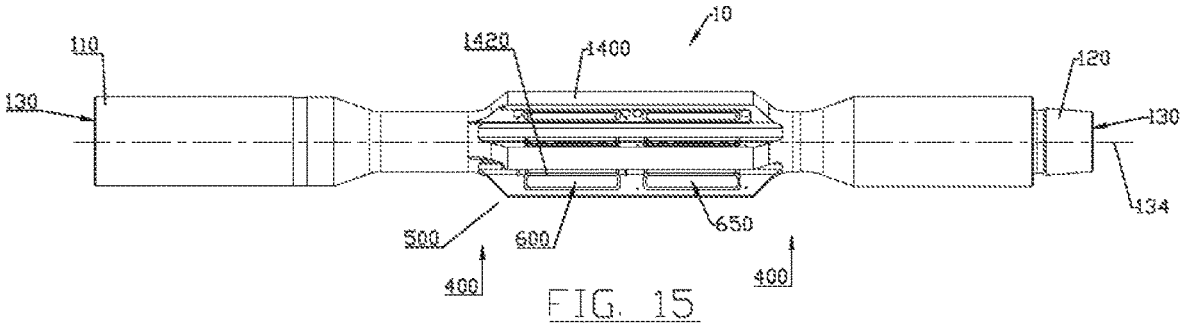
FIG. 15 is a side perspective view of the body portion shown in FIG. 14.
Figure 16:
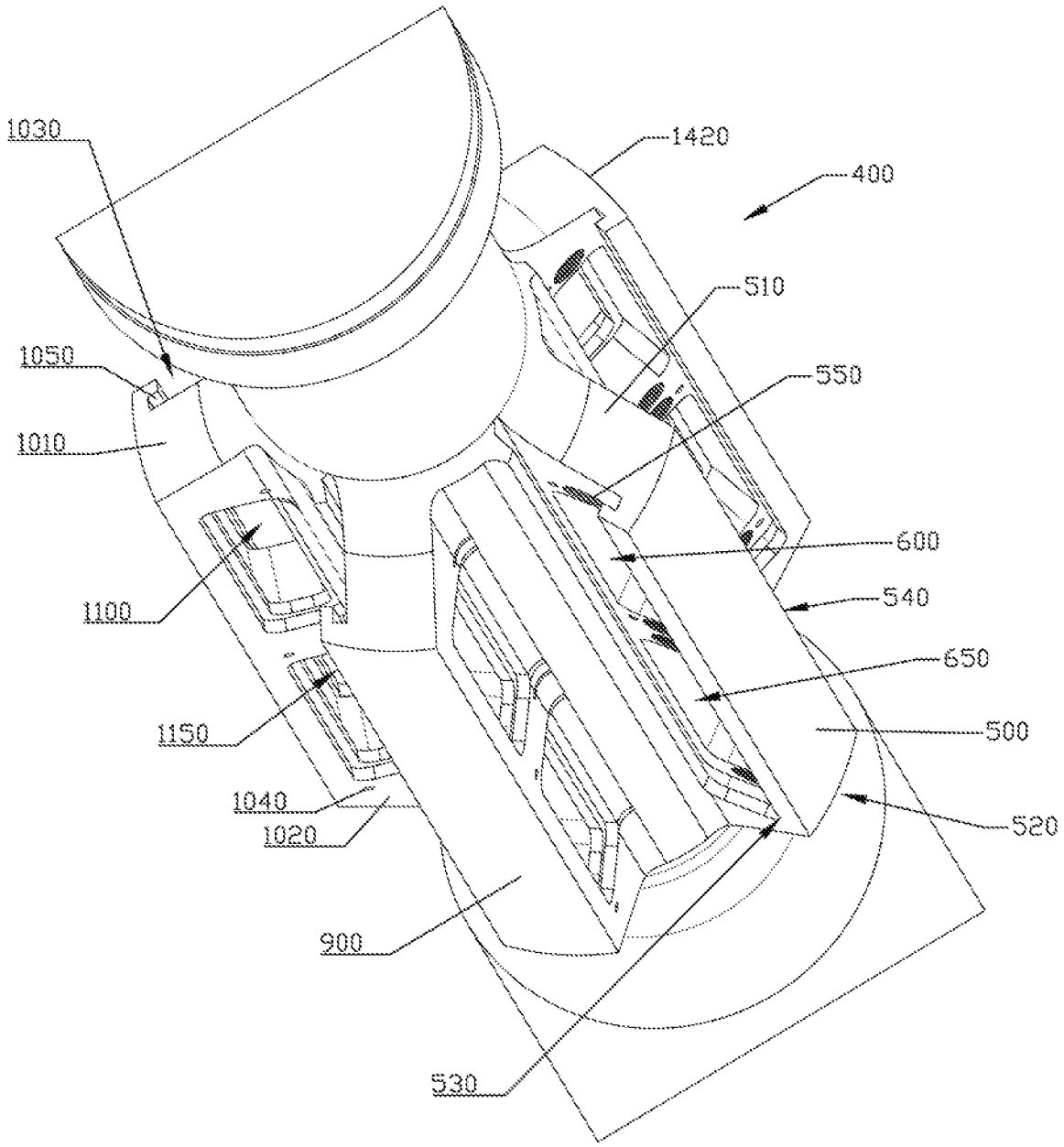
FIG. 16 is an enlarged perspective view of the ridge portion of the body portion of the magnet tool of FIG. 1.
Figure 17:
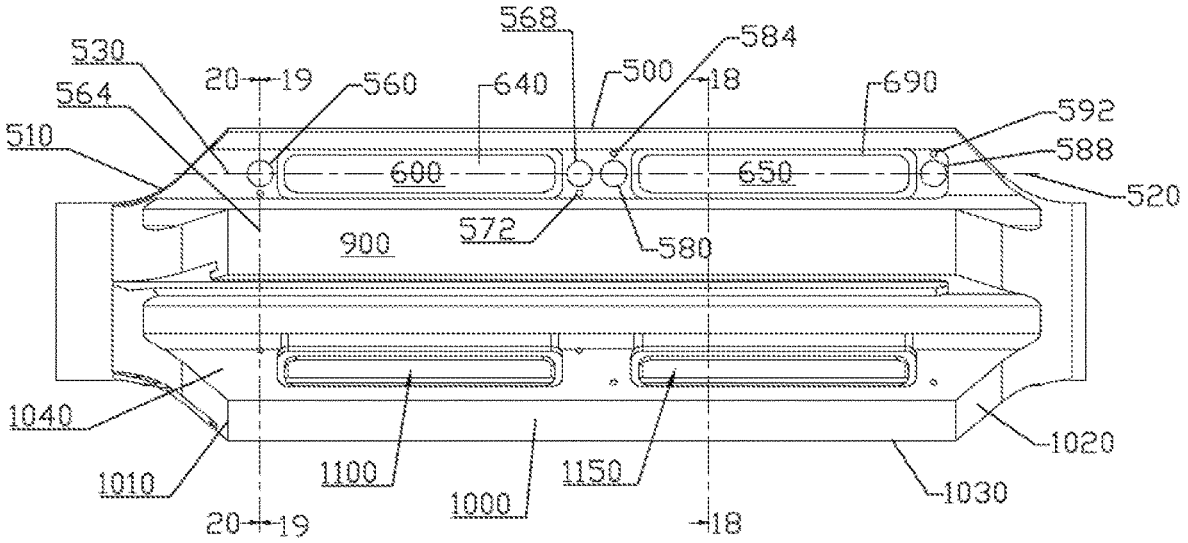
FIG. 17 is a side perspective view of the plurality of ridges shown in FIG. 14.
Figure 18:
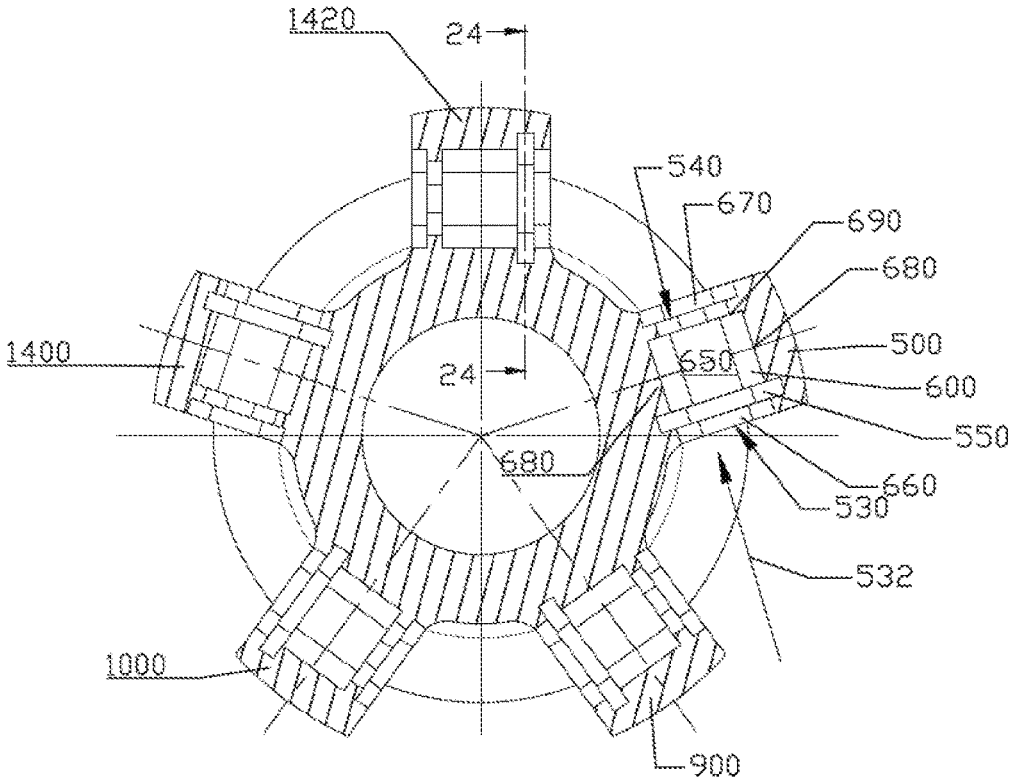
FIG. 18 is a sectional view of the body portion taken through the section line 18--18 of FIG. 17.
Figure 19:
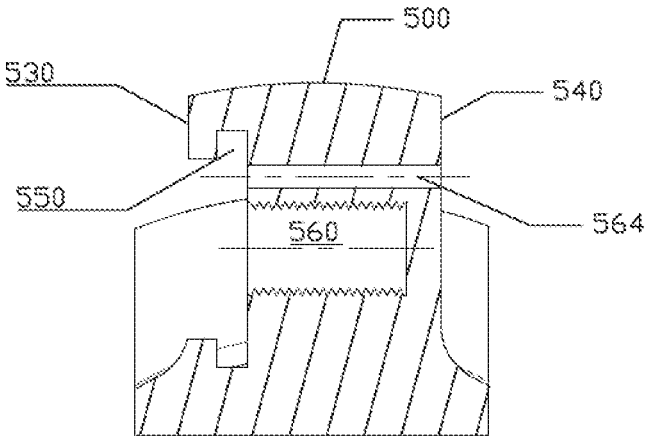
FIG. 19 is a sectional view of one of the ridges of the body portion taken through the section line 19--19 of FIG. 17.
Figure 20:
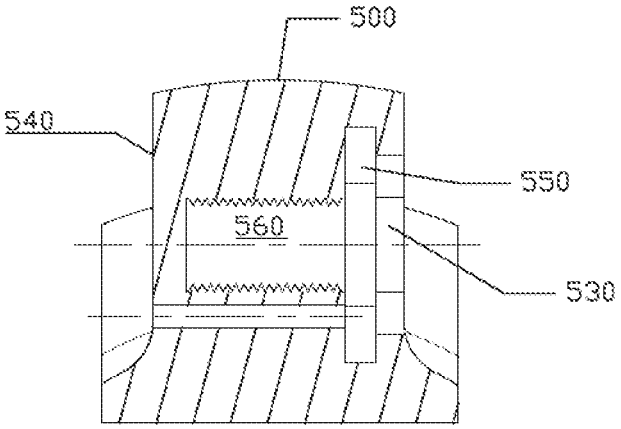
FIG. 20 is a sectional view of one of the ridges of the body portion taken through the section line 20--20 of FIG. 17.
Figure 21:
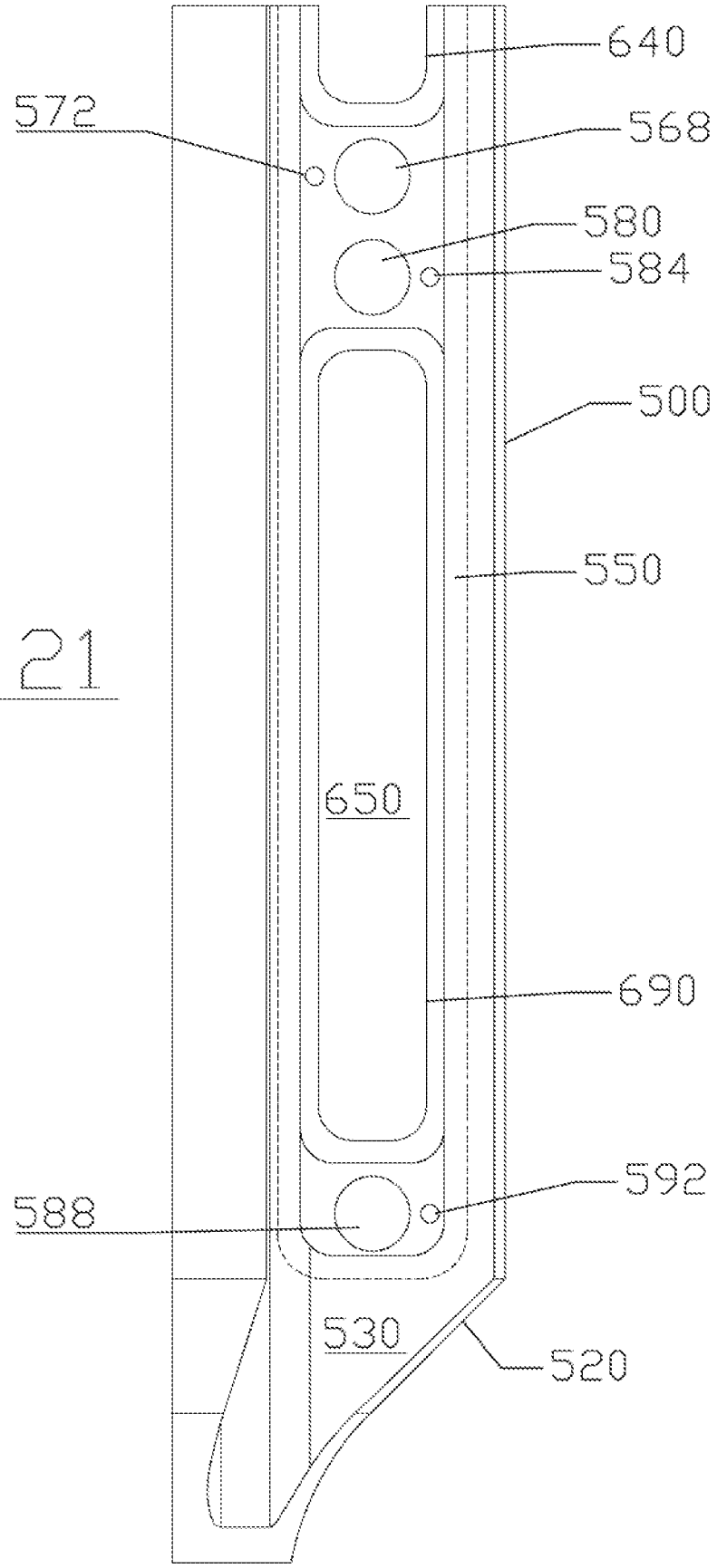
FIG. 21 is a side perspective view of one of the ridges shown in FIG. 14.
Figure 22:
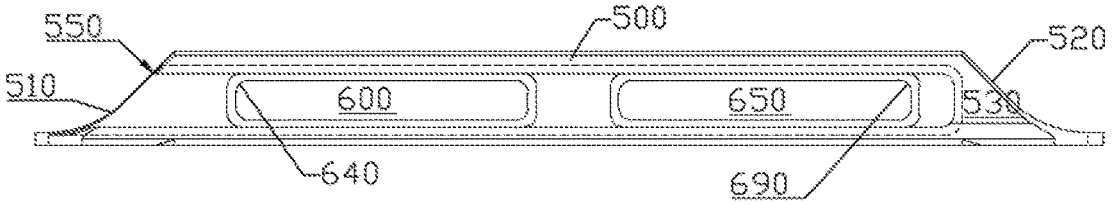
FIG. 22 is a side view of one of the ridges shown in FIG. 14.
Figure 23:
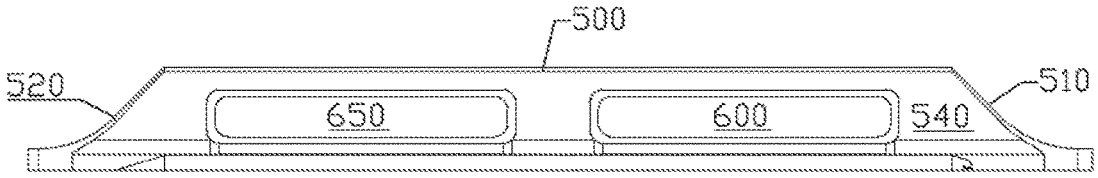
FIG. 23 is a side view of one of the ridges shown in FIG. 14 viewed from the opposite side as shown in FIG. 22.
Figure 24:
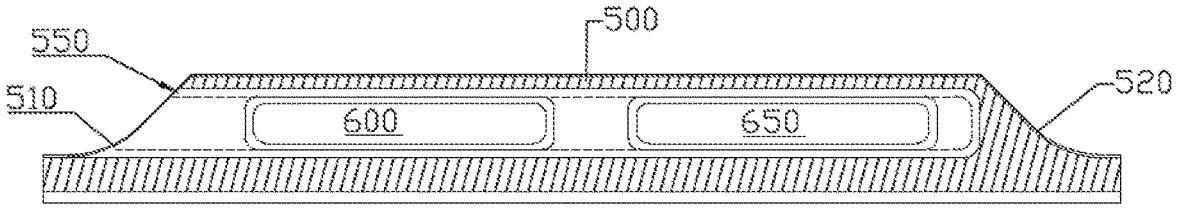
FIG. 24 is a sectional view of one of the ridges of the body portion taken through the section line 24--24 of FIG. 18.

FIG. 14 is a perspective view of body portion 100 of magnet tool 10 shown without magnets for clarity. FIG. 15 is a side perspective view of body portion 100. FIG. 16 is an enlarged perspective view of plurality of ridges 200 of magnet tool 10. FIG. 17 is a side perspective view of plurality of ridges 200. FIG. 18 is a sectional view of body portion 100 taken through section line 18--18 of FIG. 17. FIG. 19 is a sectional view of ridge 500 of body portion 100 taken through section line 19--19 of FIG. 17. FIG. 20 is a sectional view of one of ridge 500 of body portion 100 taken through the section line 20--20 of FIG. 17. FIG. 21 is a side perspective view of ridge 500. FIG. 22 is a side view of ridge 500 taken from side 530. FIG. 23 is a side view of ridge 500 taken from side 540. FIG. 24 is a sectional view of ridge 500 of body portion 100 taken through the section line 24--24 of FIG. 17.

In various embodiments each of the magnetized longitudinal ridges can be constructed in a substantially similar manner though the use of inserting a plurality of magnets in openings of the ridges. Representative magnetized longitudinal ridge 500 will be explained in detail below, however, it is to be understood that longitudinal ridges 900, 1000, 1400, and 1420 are substantially similar to ridge 500 and will not be separately described.

First ridge 500 can comprise first end 510 and second end 520, and include first side 530 and second side 540. First ridge can have first opening 600 and second opening 650 which openings can each house or contain a plurality of magnets.

First opening 600 can have first side 610 and second side 620 with sides walls 630. Adjacent second side 620 can be reduced area 640.

Second opening 650 can have first side 660 and second side 670 with sides walls 680. Adjacent second side 670 can be reduced area 690.

First ridge 500 can include slot 550 for first ridge which is located on the first sides 610, 660 of first 600 and second 650 openings. Slot 550 can accept one or more retaining plates 800,800' to retain in place magnets housed or stored in first 600 and second 650 openings.

Figure 8:
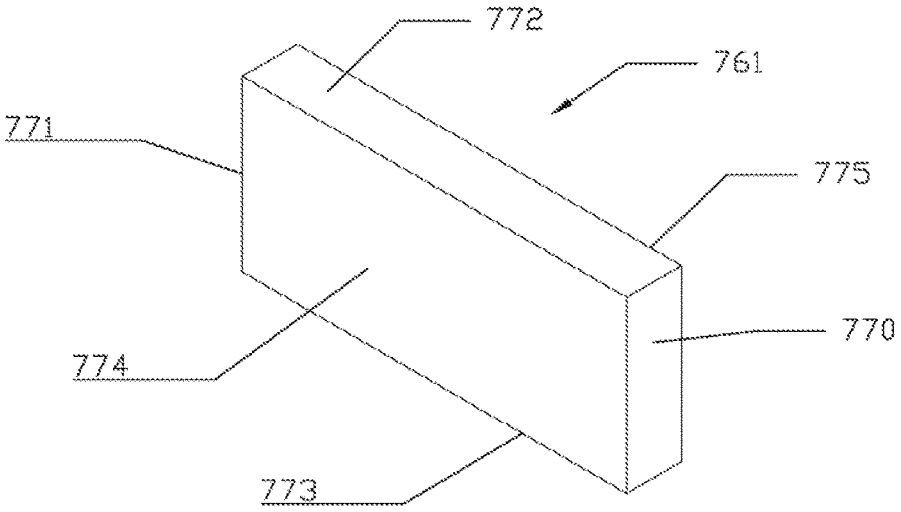
FIG. 8 is a perspective view of a magnet which can be used in the various embodiments.
Figure 9:
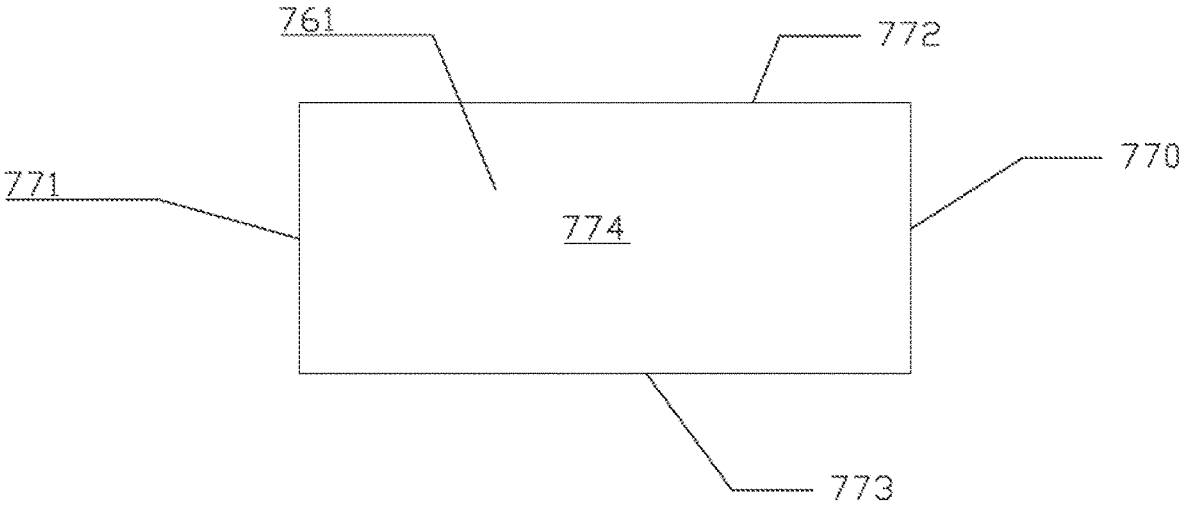
FIG. 9 is a front view of the magnet shown in FIG. 8.

FIG. 8 is a perspective view of an exemplar magnet 761 which can be used in the various embodiments. FIG. 9 is a front view of magnet 761. Magnet 761 can be a conventionally available high strength magnet and have a monolithic rectangular shape. In one embodiment the north and south poles can be located on the first 770 and second 771 ends. In another embodiment the north and south poles can located on the top 772 and bottom 773. In still another embodiment the north and south poles can be located on the first 774 and second 775 faces.

Figure 10:
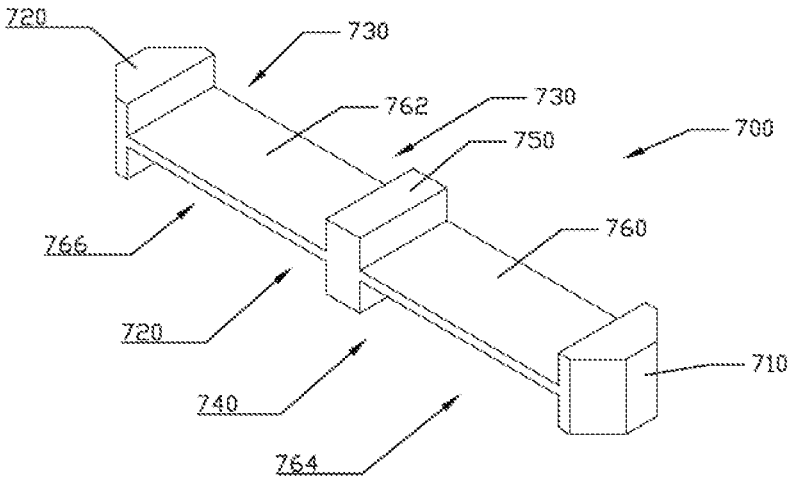
FIG. 10 is a perspective view of a spacer which can be used with the magnet tool shown in FIG. 1.
Figure 11:
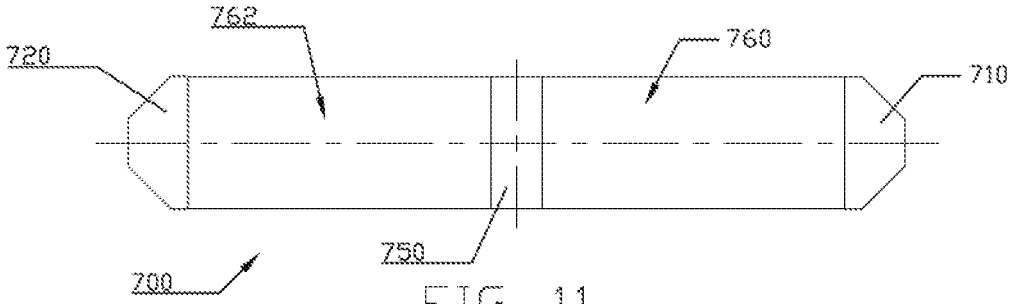
FIG. 11 is a top view of the spacer of FIG. 10.
Figure 12:
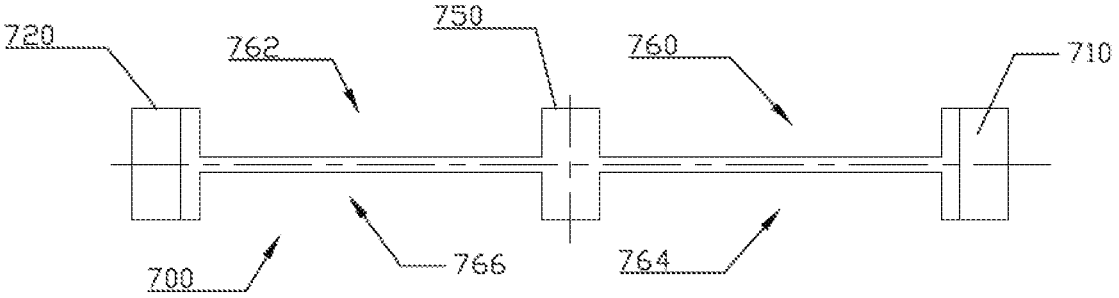
FIG. 12 is side view of the spacer of FIG. 10.

FIG. 10 is a perspective view of spacer 700 which can be used with magnet tool 10. FIG. 11 is a top view of spacer 700. FIG. 12 is side view of spacer 700.

Spacer 700 can comprise first end 710 and second end 720, and have first side 730 and second side 740. Spacer can include middle portion 750 with first 760, second 762, third 764, and fourth 766 recessed areas. Spacer can be used to retain and space apart a plurality of magnets. First 760, second 762, third 764, and fourth 766 recessed areas can respectively space apart first 761, second 763, third 765, and fourth 767 magnets.

A plurality of magnets can be included in each opening 600 and 650. Multiple magnets can be used in each opening in each ridge and the multiple magnets can be spaced apart and positioned using a spacer. The pole orientation of such multiple magnets can be controlled by the user depending on the manner of inserting such magnets in the spacer. In one embodiment poles like poles are faced toward one another. In another embodiment, unlike poles are faced toward one another.

Spacer 700 with spaced apart first 761, second 763, third 765, and fourth 767 magnets can be inserted into first opening 600 of ridge 500. Spacer 700' with spaced apart first 761', second 763', third 765', and fourth 767' magnets can be inserted into second opening 650 of ridge 500. Spacer 700 can be comprised of a non-ferrous magnet material. First 760, second 762, third 764, and fourth 766 recessed areas can respectively space apart first 761, second 763, third 765, and fourth 767 magnets. Additionally, first 761, second 763, third 765, and fourth 767 magnets can be of differing strengths and/or polarity (i.e., north and south pole configurations).

After being placed in an opening, the plurality of magnets can be held in place in first opening using a retaining plate 8000 on one side of ridge 500 (e.g., first side 530), and a reduced area 640 of first opening 600 on second side 540. In this manner both first side 530 and second side 540 have magnets and a single retaining place can be used to retain in place the magnets for both sides 530 and 540.

Figure 13:
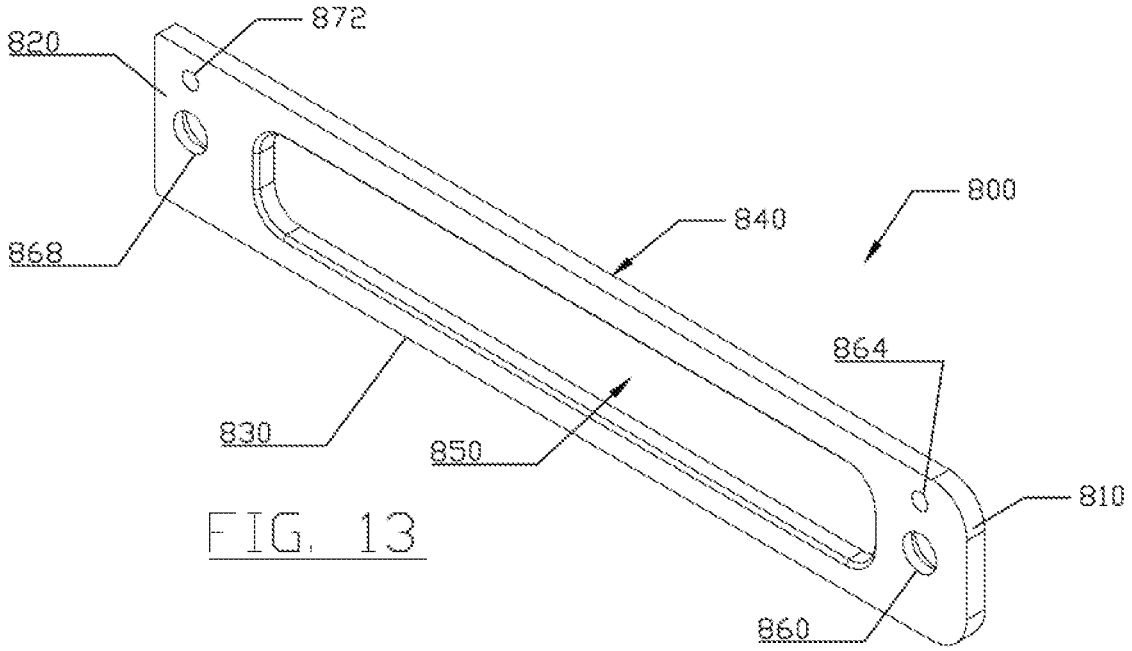
FIG. 13 is a perspective view of a retaining plate which can be used with the magnet tool shown in FIG. 1.

FIG. 13 is a perspective view of a retaining plate 800 which can be used with magnet tool 10. Retaining plate 800 can comprise first end 810 and second end 820, and have first side 830 and second side 840. Retaining plate 800 can include at least one opening 850 to provide access to the magnets housed or stored in the slot opening over which retaining plate is located. In various embodiments it can include a plurality of openings 850,852 to provide access to the magnets housed or stored in the slot opening over which retaining plate is located.

Retainer plate 800, on first end 810, can include locking openings 860 and 864 for a grub screw and bissel pin. On second end 820 it can include locking openings 868 and 872 for a grub screw and bissel pin.

FIG. 2 shows two retaining plates 800,800' slid or inserted into slot 550 of ridge 500 respectively over openings 600, 650. To lock or hold in place retaining plate over a respective opening, various quick lock/quick unlock schemes may be used. One example can be a grub screw connection in combination with bissel screws or rods. The various grub screws can be biased towards the retaining plate 800 (such as spring biased). In this manner grub screws during use (such as when magnet tool 10 encounters vibrations) will tend to be retained in their locked position (i.e., in locking openings 868 of retaining plate 800).

Making up of the magnets in one magnetic ridge 500 will be described below. Making up the remainder of the magnetic ridges (900, 1000, 1400, and 1420) for magnet tool 10 can be performed in a substantially similar manner and will not be described separately. Spacer 700 with spaced apart first 761, second 763, third 765, and fourth 767 magnets (first 760, second 762, third 764, and fourth 766 recessed areas can respectively space apart first 761, second 763, third 765, and fourth 767 magnets) can be inserted into first opening 600 of ridge 500. Spacer 700' with spaced apart first 761', second 763', third 765', and fourth 767' magnets (first 760', second 762', third 764', and fourth 766' recessed areas can respectively space apart first 761', second 763', third 765', and fourth 767' magnets) can be inserted into second opening 650 of ridge 500. Retaining plate 700' can be slid into slot 550 until above second opening 650 of ridge 500. Retaining plate 700 can be slid into slot 550 until above first opening 650 of ridge 500. Now first 761', second 763', third 765', and fourth 767' magnets are retained in opening 650 between reduced area 690 and retaining plate 800'. Additionally, first 761, second 763, third 765, and fourth 767 magnets are retained in opening 600 between reduced area 640 and retaining plate 800. Grub screws 582, 590 are respectively threadably backed out of openings 580,588 to interlock with openings 820',860' of retaining plate 800'—locking in place retaining plate 800' over opening 650. Grub screws 562, 578 are respectively threadably backed out of openings 560,568 to interlock with openings 820,860 of retaining plate 800 locking in place retaining plate 800 over opening 600. Additionally, bissel pins 586,594 are used to also lock in place retaining plate 800' (inserted into openings 584,592). Bissel pins 586,594 are used to also lock in place retaining plate 800' (inserted into openings 584,592). Bissel pins 566,574 are used to also lock in place retaining plate 800 (inserted into openings 564,572).

After use to remove and/or replace magnets the opposite procedure to that described in the immediately proceeding paragraph can be used where the bissel pins are pulled out, and the grub screws are respectively threaded into their respective grub screw opening, and the retaining plates slid out of slot 550 so that the magnets and spacers can be removed from openings 650 and 600.

Magnet tool 10 retrieves ferrous metal debris from a well, and includes an elongate tool body 100 having a plurality of circumferentially arranged ribs 500, 900, 1000, 1400, and 1420 each for holding a plurality of magnets.

After usage, magnet tool 10 can be cleaned relatively easily.

According to the method, the tool is provided with the ribs and the magnets, and is suspended in a well to retrieve various metal debris.

Inserting Magnets in Ridges for Tool Body 100.

FIGS. 25-30 schematically indicate a method of inserting and locking in place a plurality of spaced apart magnets in one of the openings 600 for magnet tool 10.

Figure 25:
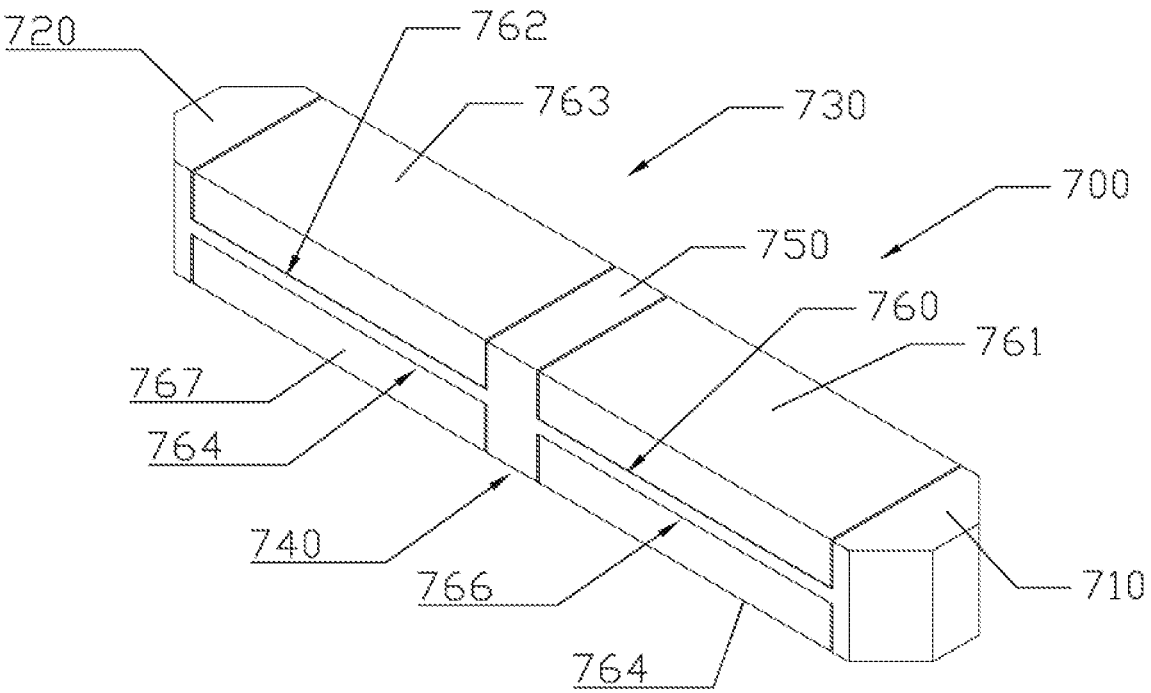
FIG. 25 is a perspective view of a spacer with plurality of magnets being inserted and spaced by the spacer.

FIG. 25 is a perspective view of a spacer 700 with plurality of magnets (761, 763, 766, 767) having been inserted and spaced by spacer 700. One set of spacer 700 with plurality of spaced apart magnets can be used in each opening of magnet tool 10 (for example, one set in opening 600 and a second set in opening 650 of ridge 500).

Figure 26:
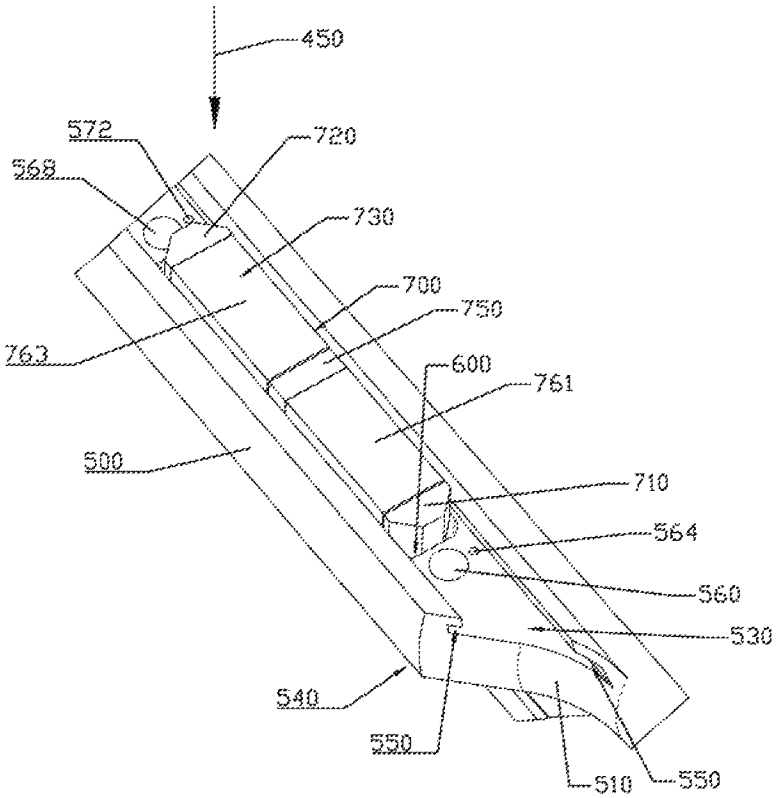
FIG. 26 is a perspective view of the spacer with plurality of spaced apart magnets of FIG. 25 now being inserted into an opening of the tool body of FIG. 14.

FIG. 26 is a perspective view of the spacer 700 with plurality of spaced apart magnets now being inserted into an opening 600 of tool body 100. Arrow 450 schematically indicates that the spacer 700 with plurality of spaced apart magnets are inserted into one of the openings (opening 600 in ridge 500). Separate spacers 700 with plurality of spaced apart magnets can be inserted into each of the remaining openings in the ridges (e.g., opening 650 of ridge 500, along with the openings in ridges 900, 1000, 1400, and 1420).

Figure 27:
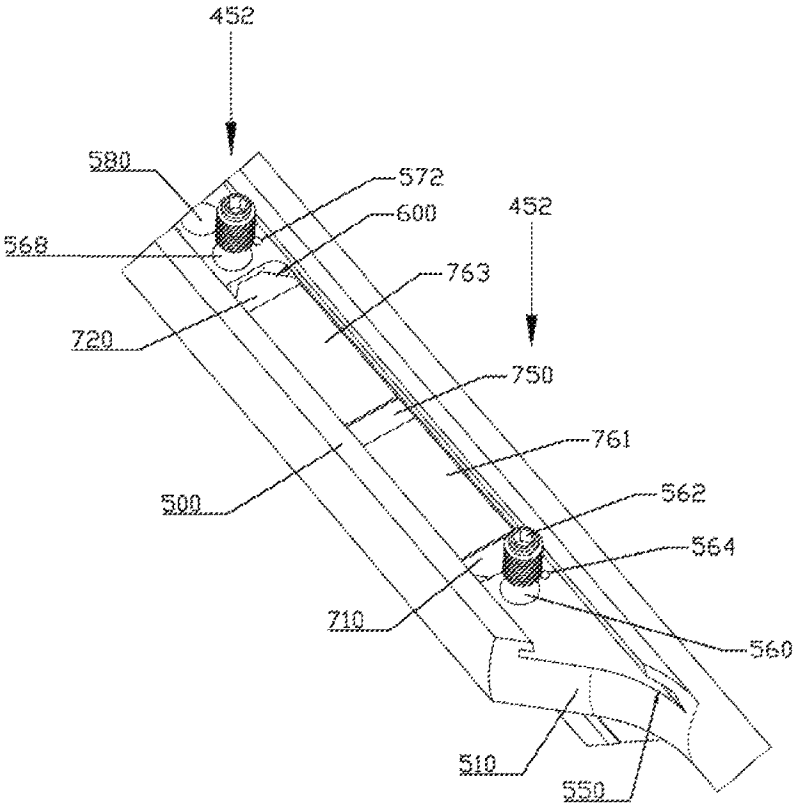
FIG. 27 is a perspective view of grub screws being inserted into their respective grub screw openings.

FIG. 27 is a perspective view of grub screws 562 and 570 being inserted into their respective grub screw openings 560 and 568. Respective grub screws can be inserted for each of the grub screw remaining openings in the ridges 500, 900, 1400, and 1420. Arrows 452 schematically indicate that the grub screws are being inserted (i.e., screwed into) their respective grub screw openings.

Figure 28:
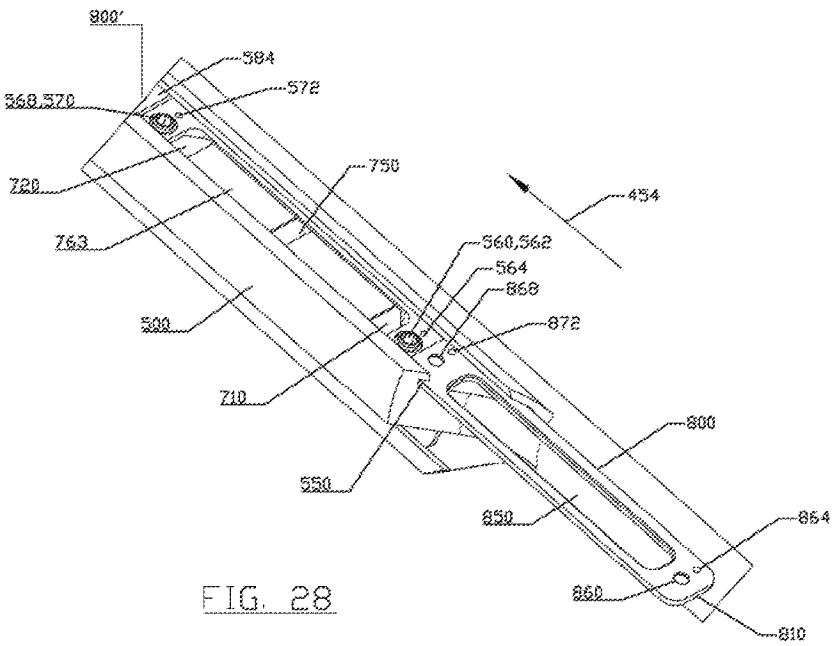
FIG. 28 is a perspective view of a retaining plate being slid in a slot to retain the spacer with plurality of spaced apart magnets in an opening in a ridge for the tool body of FIG. 14.

FIG. 28 is a perspective view of a retaining plate 800 being slid in a slot 550 in the first ridge 500 to retain the spacer 700 with plurality of spaced apart magnets in an opening 600 of first ridge 500. Arrow 454 schematically indicates retaining plate 800 being inserted/slit into slot 550 over first opening 600. Because the same slot 550 is used with the slot being closed at second end 520 of ridge 500, retaining plate 800' must be slid first in slot 550 over spacer 700' and the plurality of spaced magnets inserted in opening 650; after which time retaining plate 800 can be slid into slot 550 over opening 600. FIG. 28 shows retaining plate 800' already installed in slot 550 over second opening 650 (although second opening 650 is not shown). Similarly, respective retaining plates can be inserted for each of the slots in the in the remaining ridges 900, 1400, and 1420.

Figure 29:
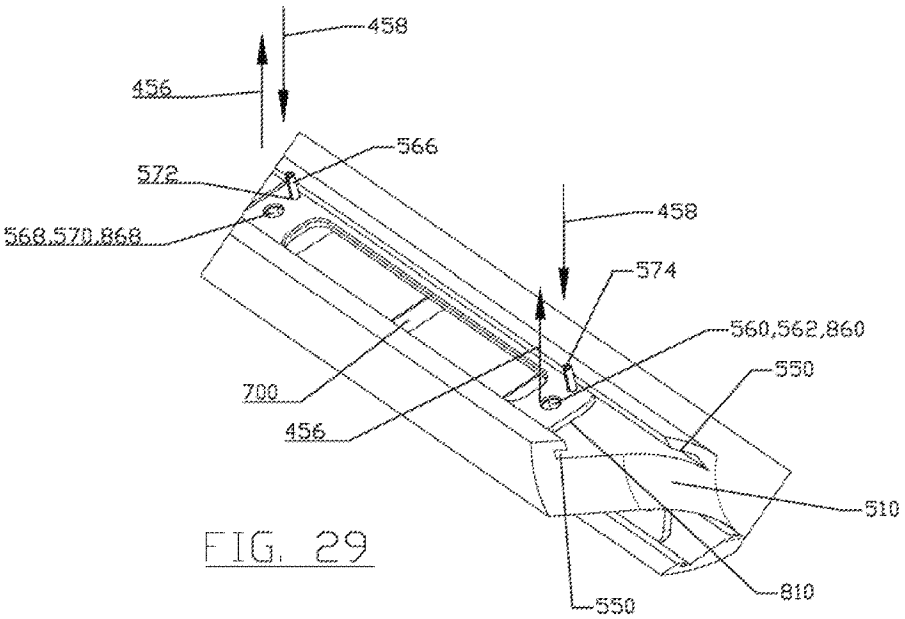
FIG. 29 shows the retaining plate of FIG. 28 now over the spacer with plurality of spaced apart magnets, and now with the grub screws backed out into their respective grub screw opening in the retaining plate, and secondarily inserting bissel pins to further hold in place retaining plate.

FIG. 29 shows the retaining plate 800 now over the spacer 700 with plurality of spaced apart magnets, and now with the grub screws (562 and 570) backed out into their respective grub screw openings (862 and 868) in the retaining plate 800, and secondarily inserting bissel pins (566 and 574) to further hold in place retaining plate 800. Arrows 456 schematically indicates the two grub screws being backed out (i.e., unscrewed into) their respective openings of plate 800 thereby locking plate 800 in position inside of slot 550. Similarly, respective backing out of grub screws can be performed for each of the remaining openings of ridges 500, 900, 1400, and 1420. Arrows 458 schematically indicates the bissel pins being inserted into their respective openings of plate 800 and openings inside of ridge 500 thereby acting as a secondary lock for plate 800 in its position inside of slot 550. Similarly, respective insertion of bissel pins can be performed for each of the remaining openings of ridges 500, 900, 1400, and 1420. Retaining plates 800, 800', etc. hold in place their respective spacers and plurality of spaced apart magnets in respective openings for ridges.

In removing the magnets from the openings in the ridges, a reverse operation of what is discussed above can be performed by removing bissel pins, screwing back in the locking grub screws, and sliding out the retaining plates from their respective holding slots. After the retaining plates are removed, the spacers with spaced apart plurality of magnets can be removed from their respective openings.

Figure 30:
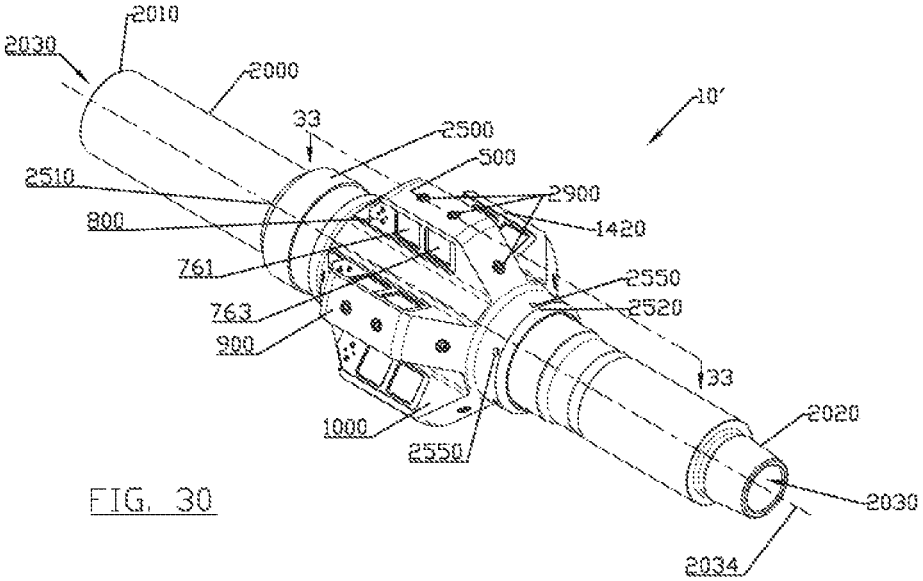
FIG. 30 is a perspective view of a second embodiment of a magnet tool having magnets in longitudinal ridges in a jetting sleeve where the sleeve is removable from the tool mandrel.
Figure 31:
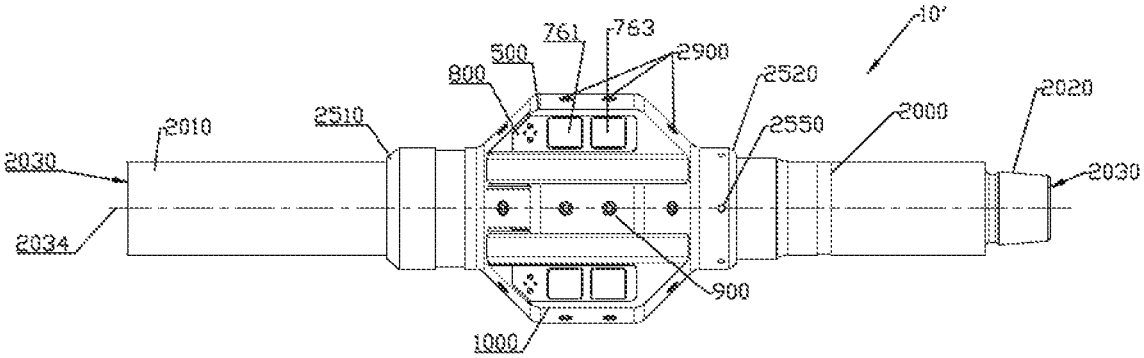
FIG. 31 is a side perspective view of the magnet tool of FIG. 30.
Figure 32:
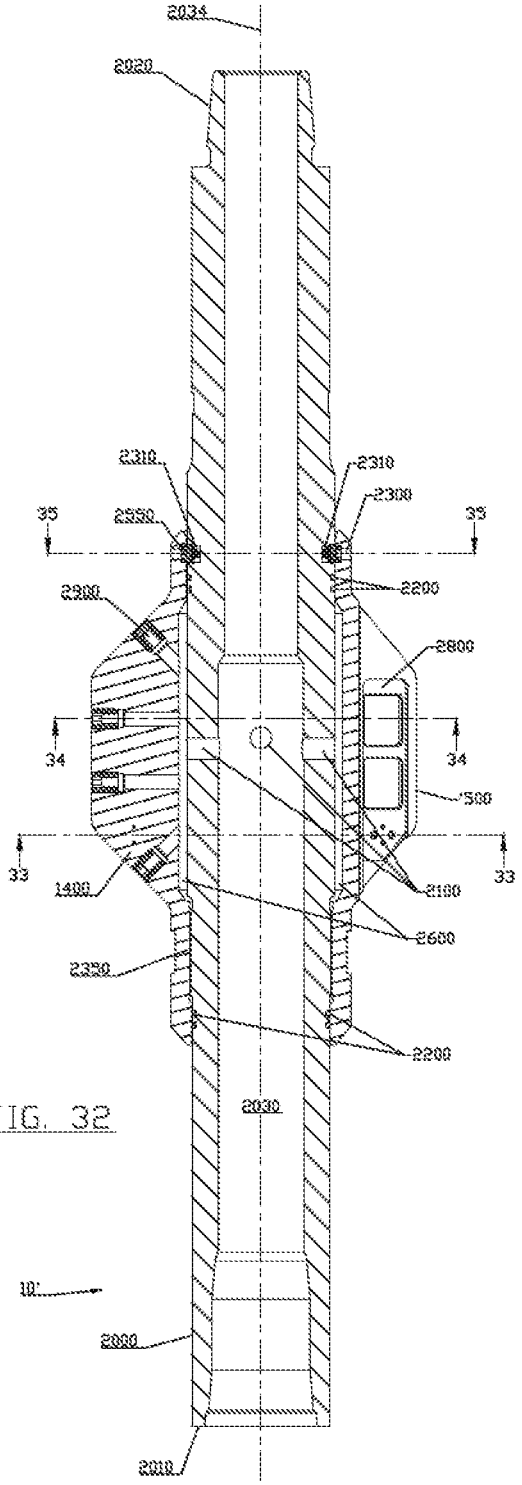
FIG. 32 is a sectional view of the magnet tool of FIG. 30 taken through ridge 500.
Figure 35:
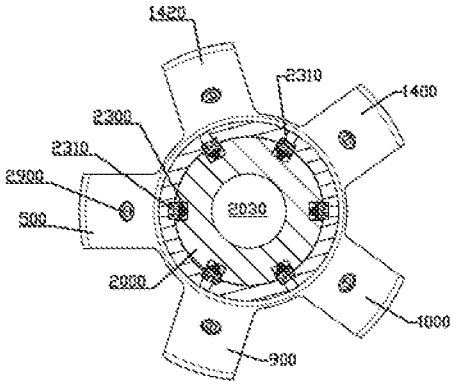
FIG. 35 is a sectional view of one of the magnet tool of FIG. 30 taken through the section line 35--35 of FIG. 32.
Figure 34:
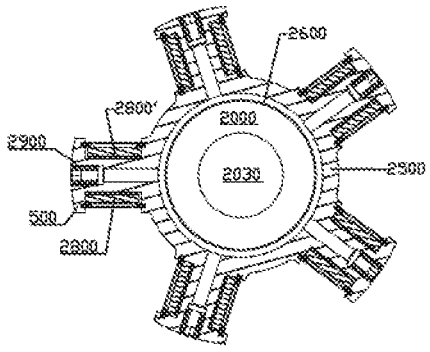
FIG. 34 is a sectional view of one of the magnet tool of FIG. 25 taken through the section line 34--34 of FIG. 32.
Figure 33:
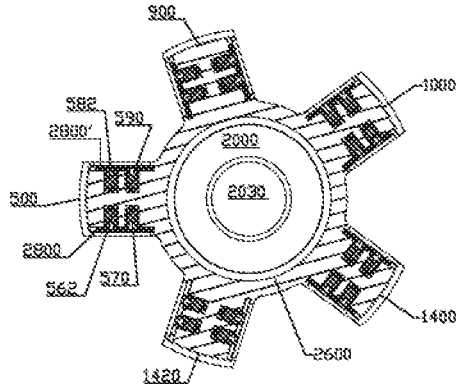
FIG. 33 is a sectional view of one of the magnet tool of FIG. 30 taken through the section line 33--33 of FIG. 32.

Detachable Sleeve With Magnetized Ridges and Jetting Ports FIG. 30 is a perspective view of a second embodiment of magnet tool 10' having various plurality of magnets in a plurality of magnetized longitudinal ridges 200 with the addition of a jetting sleeve 2500 where the sleeve is removable from the tool mandrel 2000. FIG. 31 is a side perspective view of magnet tool 10'. FIG. 32 is a sectional view of magnet tool 10' taken through ridge 500. FIG. 33 is a sectional view of magnet tool 10' taken through the section line 33--33 of FIG. 32. FIG. 34 is a sectional view of magnet tool 10' taken through the section line 34--34 of FIG. 32. FIG. 35 is a sectional view of magnet tool 10' taken through the section line 35--35 of FIG. 32.

Generally, magnet tool 10' comprises tool mandrel 2000 with detachably connectable magnetized sleeve 2500. Sleeve 2500 can include a plurality of magnetized longitudinal ridges 200 (e.g., ridges 500, 900, 1000, 1400, and 1420) wherein the magnetized ridges have openings or pockets on either side of the ridges for magnets. Each of the plurality of magnetized ridges can include a plurality of magnets for collection of ferrous debris. Between pairs of magnetized ridges can be collection areas for ferrous debris. In this embodiment, detachable sleeve 2500 is shown having a plurality of jetting ports 2700 in each of its plurality of magnetized ridges The detachably connectable magnetized sleeve 2500 provides flexibility with magnet tool 10'. In different embodiments one can use the same mandrel 2000 and have several different types of sleeves (2500, 2500', 2500") detachably connectable to mandrel 2000 (either at different times or connected simultaneously), or no sleeve at all which reduces inventory and allows better utilization of assets.

With different sleeves, for the same mandrel 2000, different set up configurations can be used which possibly change one or more of the following features/functions/properties:

(a) number of magnetized ridges;

(b) size of the magnetized ridges;

(c) configuration of the magnetized ridges including but not limited to height and width of the ridges, orientation of the ridges, length of the ridges and spacing of the ridges;

(d) number of jetting ports;

(e) configuration of the jetting ports; and (f) number of magnets and/or size of magnets.

In one embodiment, it is possible to reconfigure magnet tool 10' at the wellsite to suit the application if so desired. In one embodiment magnet tool 10' can be shipped with at least two sleeves 2500 and 2500' with only one of the sleeves detachably connected to mandrel 2000. During use at the well site, after being used in the well the first connected sleeve (e.g., 2500) can be removed from mandrel and second sleeve (e.g., 2500') detachably connected to mandrel 2000 and then lowered downhole for wellbore operations. In one embodiment sleeve 2500 and 2500' are substantially similar to each other. In another embodiment sleeve 2500 and 2500' of differing configurations based on one or more of the above specified features/functions/properties. In one embodiment the switching between sleeve 2500 and 2500' is performed before magnet tool 10' is lowered downhole for wellbore operations.

In another embodiment, differing mandrels (e.g., 2000 and 2000') can be used with sleeve 2500. For example, a mandrel 2000' with brush and/or scraper elements can be attached to sleeve 2500 and lowered downhole.

With the above interchangeable embodiments a single magnet tool 10' can be shipped to a user and such tool configured at the wellsite according the user's needs by selectively choosing either from a plurality of sleeves and/or a plurality of mandrels to be detachably connected together and perform wellbore cleaning operations downhole.

Maintenance/Inspection

Figure 43:
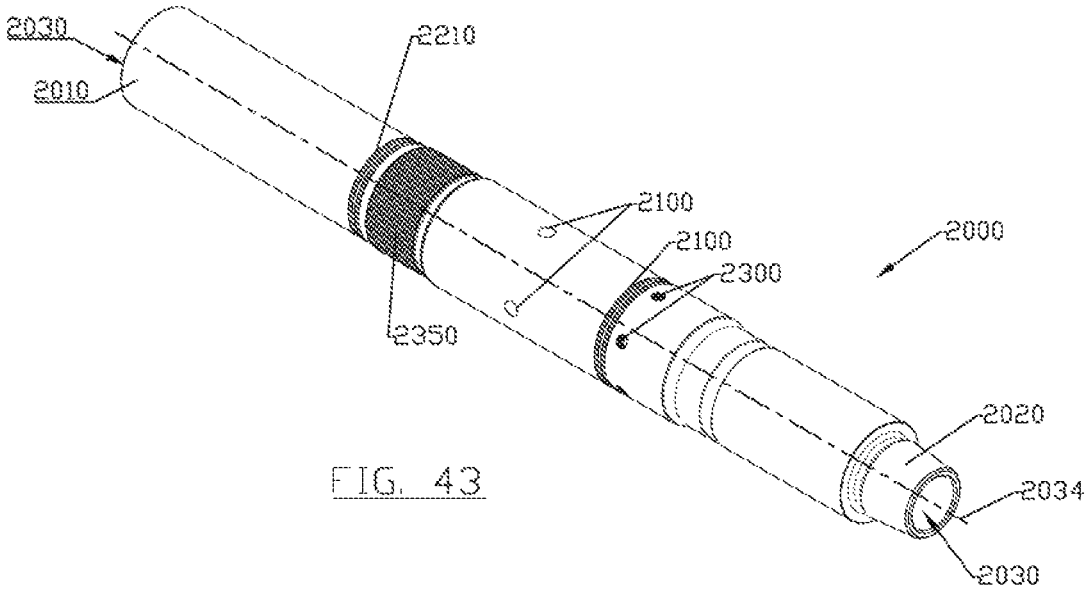
FIG. 43 is a perspective view of the mandrel portion of the magnet tool of FIG. 30.
Figure 44:
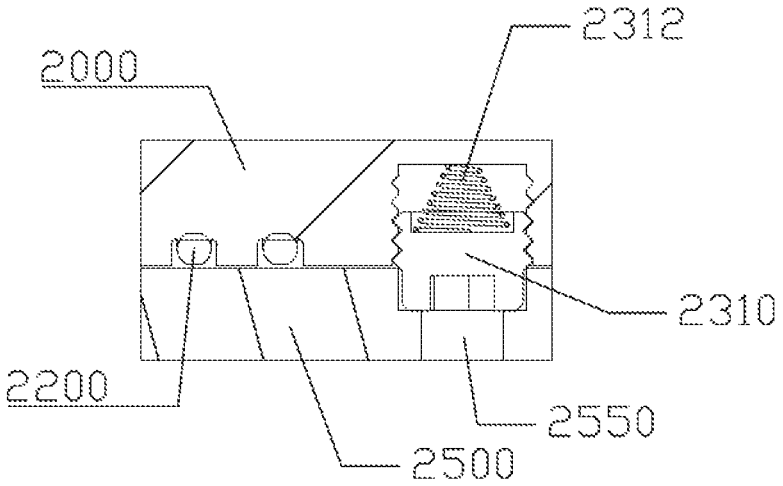
FIG. 44 is an enlarged sectional view of the connection between the mandrel of FIG. 43 and the sleeve of FIG. 47.
Figure 45:
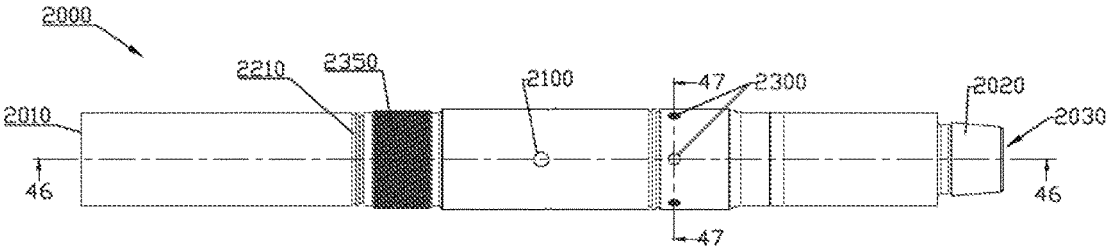
FIG. 45 is a side perspective view of the mandrel portion of FIG. 43.
Figure 46:
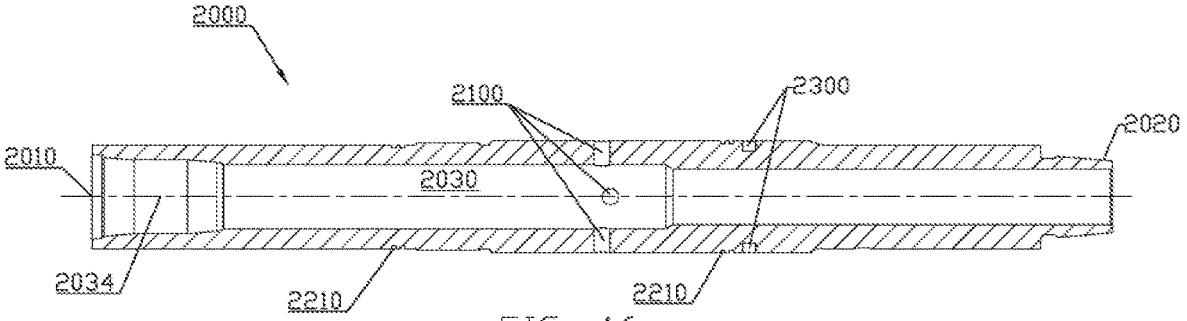
FIG. 46 is a sectional view of the mandrel taken through the section line 46--46 shown in FIG. 43.
Figure 47:
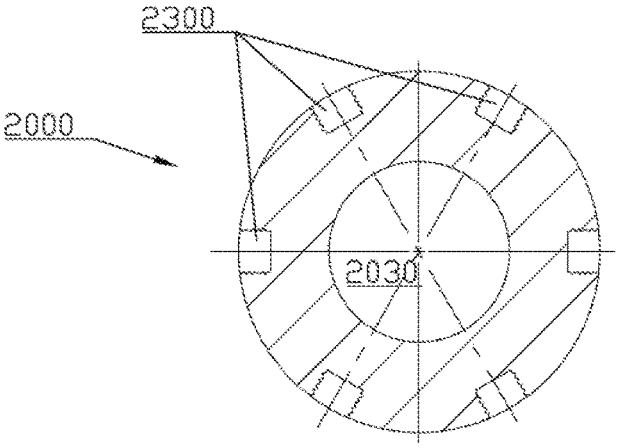
FIG. 47 is a sectional view of the mandrel taken through the section line 47--47 shown in FIG. 43.

Downhole tool bodies must be tested periodically using non-destructive magnetic particle inspection. If the sleeve is not part of the body it does not need to be inspected, saving costs FIG. 33 is a perspective view of mandrel 2000. FIG. 44 is an enlarged sectional view of the connection between mandrel 2000 and sleeve 2500. FIG. 45 is a side perspective view of mandrel 2000. FIG. 46 is a sectional view of mandrel 2000 taken through the section line 46--46 shown in FIG. 43. FIG. 47 is a sectional view of mandrel 2000 taken through the section line 47--47 shown in FIG. 43.

Mandrel 2000 can include upper box end 2010, lower pin end 2020, central bore 2030 running through mandrel 2000, and longitudinal axis 2034. In one embodiment, upper end 2010 can be configured for receiving a tubular for suspending tool body in the well, and for passing fluid through central bore 2030 in mandrel 2000. In other embodiments, tool 10' may be configured for connection to a wireline, or to another type of tubular for suspending the tool in the well.

Figure 48:
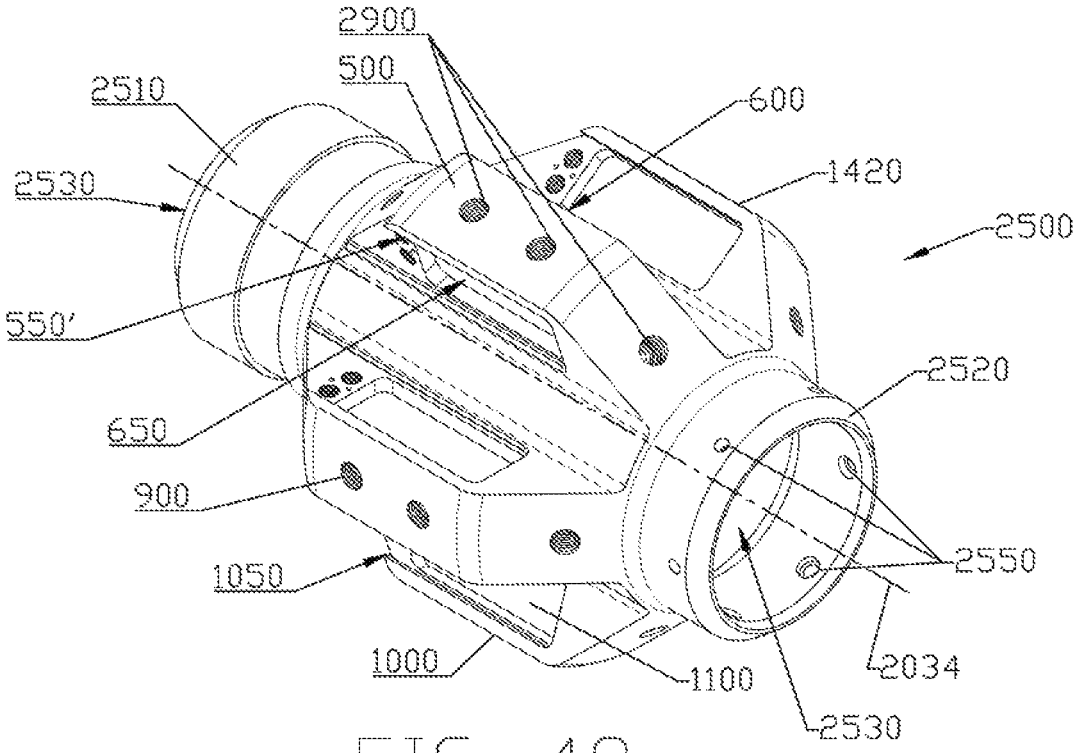
FIG. 48 is a perspective view of the sleeve portion of the magnet tool of FIG. 30 shown without magnets, spacers, and retaining plates.
Figure 49:
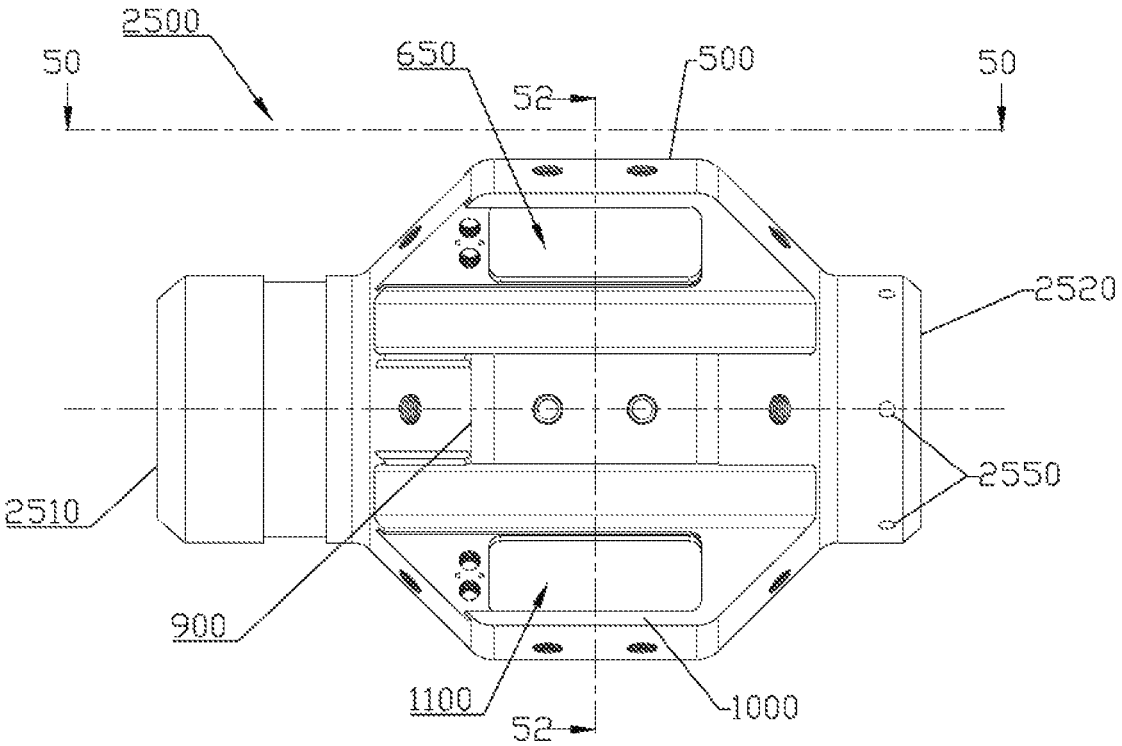
FIG. 49 is a side perspective view of the sleeve portion of the magnet tool of FIG. 30 shown without magnets, spacers, and retaining plates.
Figure 50:
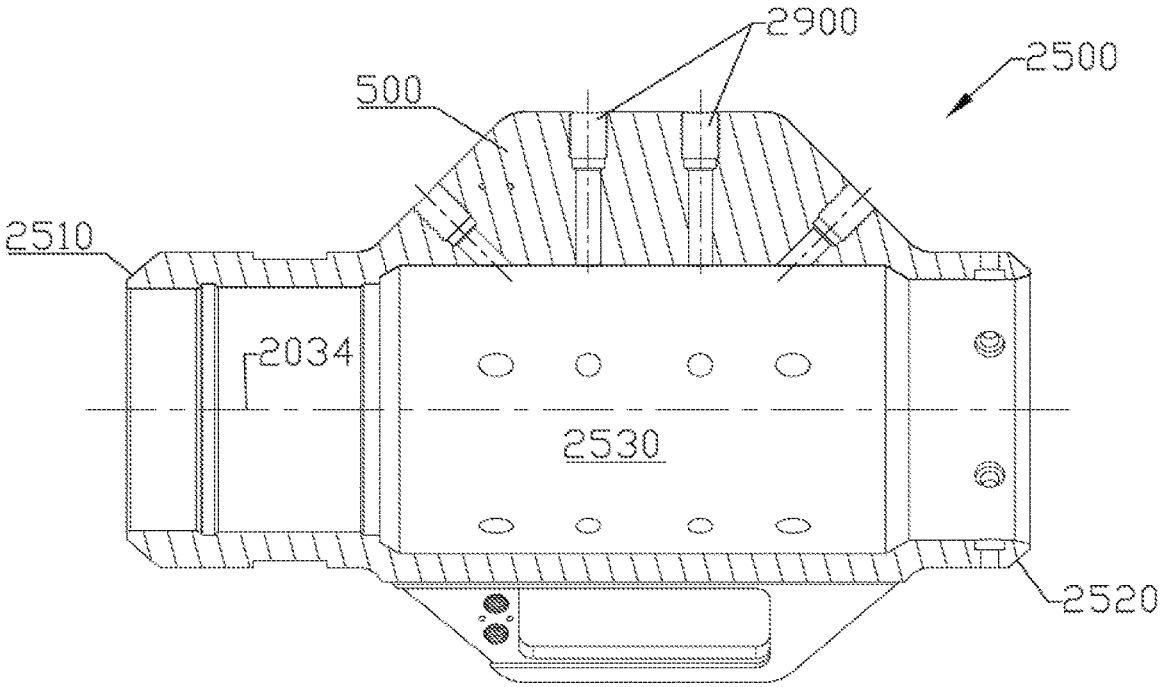
FIG. 50 is a sectional view of the sleeve taken through the middle of the ridge schematically indicated by section line 50--50 shown in FIG. 49.
Figure 51:
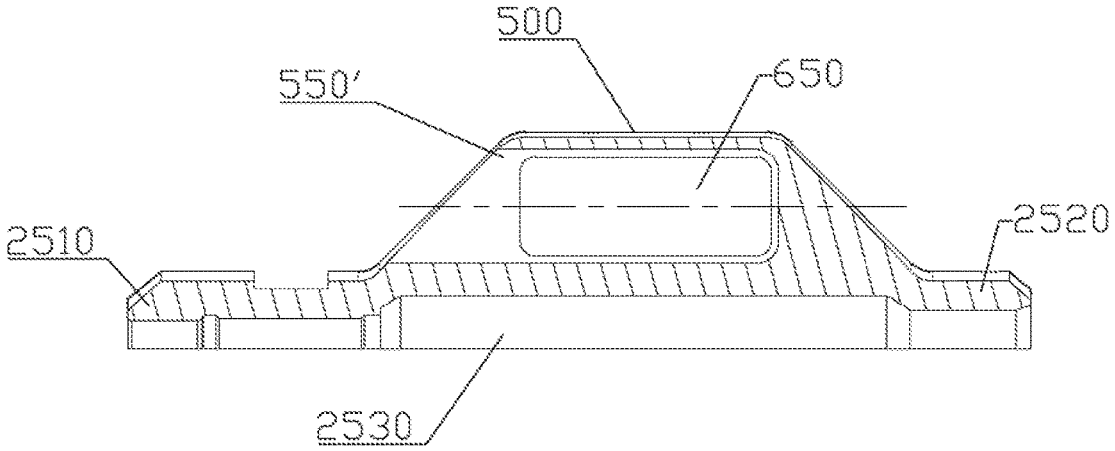
FIG. 51 is a sectional view of the sleeve taken towards the outer edge of the ridge schematically indicated by section line 50--50 shown in FIG. 49.
Figure 52:
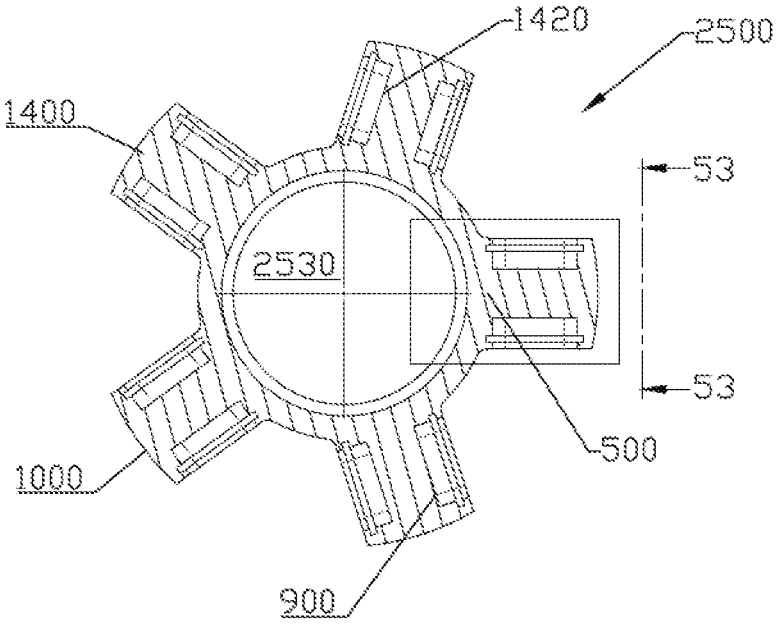
FIG. 52 is a sectional view of the sleeve taken through the section line 52--52 shown in FIG. 54.
Figure 53:
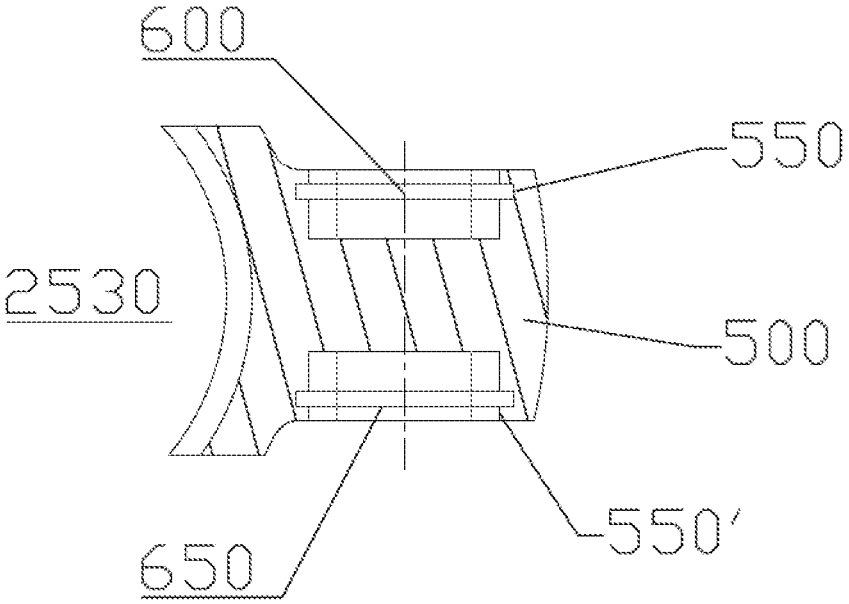
FIG. 53 is a sectional view of the sleeve taken through the section line 53--53 shown in FIG. 52.
Figure 54:
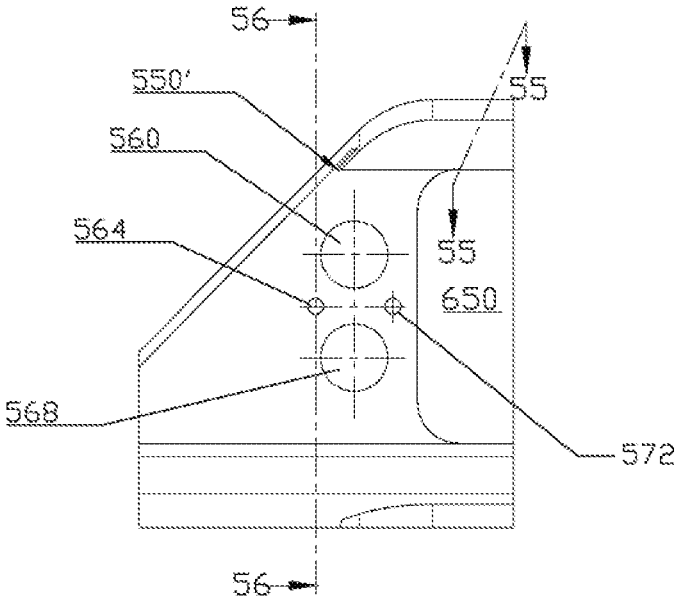
FIG. 54 is an enlarged view of the sleeve shown in section of FIG. 52.
Figure 55:
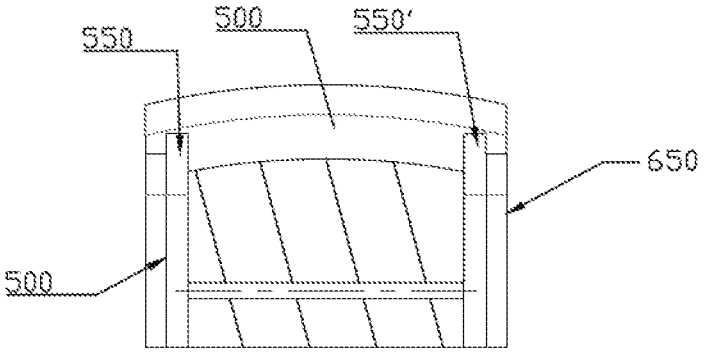
FIG. 55 is a sectional view of the ridge taken from section line 55--55 shown in FIG. 54.

FIG. 48 is a perspective view of sleeve 2500 of magnet tool 10' shown without magnets, spacers, and retaining plates. FIG. 49 is a side perspective view of sleeve 2500 shown without magnets, spacers, and retaining plates. FIG. 50 is a sectional view of sleeve 2500 taken through the middle of ridge 500 schematically indicated by section line 50--50 shown in FIG. 49. FIG. 51 is a sectional view of sleeve 2500 taken towards the outer edge of ridge 500 schematically indicated by section line 50--50 shown in FIG. 49. FIG. 52 is a sectional view of sleeve 2500 taken through section line 52--52 shown in FIG. 49. FIG. 53 is a sectional view of sleeve 2500 taken through section line 53--53 shown in FIG. 52. FIG. 54 is an enlarged view of sleeve 2500 shown in section of FIG. 52. FIG. 55 is a sectional view of ridge 500 taken from section line 55--55 shown in FIG. 54.

Figure 56:
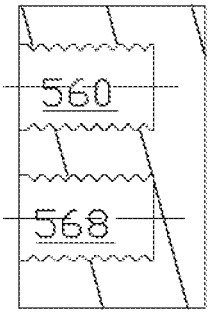

FIG. 56 is a sectional view of ridge 500 taken from section line 56--56 shown in FIG. 54.

Detachable sleeve 2500 can include first end 2510, second end 2520, longitudinal bore 2530, and a plurality of magnetized ridges. In one embodiment detachable sleeve 2500 can include ridges five magnetized longitudinal ridges (500, 900, 1000, 1400, and 1420) which are symmetrically spaced radially about longitudinal axis 2034. In one embodiment the five longitudinal ridges can be equally radially spaced about 72 degrees apart. In various embodiments the individual ridges can be constructed substantially similar to each other. In varying embodiments a varying numbers of longitudinal ridges can be used including 3, 4, 5, 6, 7, 8, 9, 10, 11, 12, 13, 14, and 15. In different embodiments a range of ridges can be used which range varies between any two of the above specified number of ridges.

Figure 36:
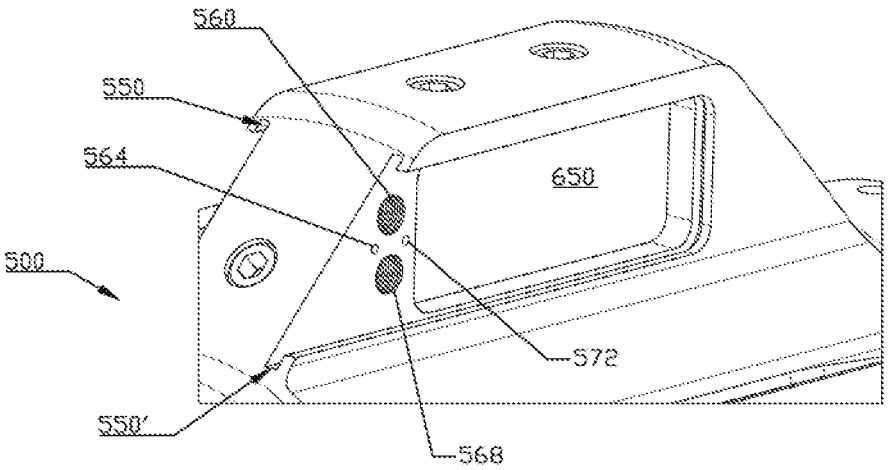
FIG. 36 is an enlarged perspective view of one of the ridge portions of the magnet tool of FIG. 30 shown without magnets, spacer and retaining plate.
Figure 37:
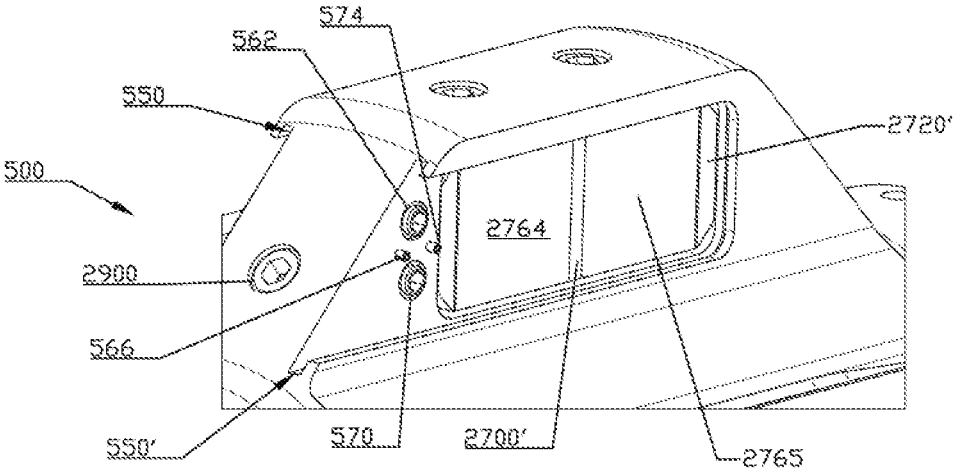
FIG. 37 is an enlarged perspective view of one of the ridge portions of the magnet tool of FIG. 30 shown without retaining plate.
Figure 38:
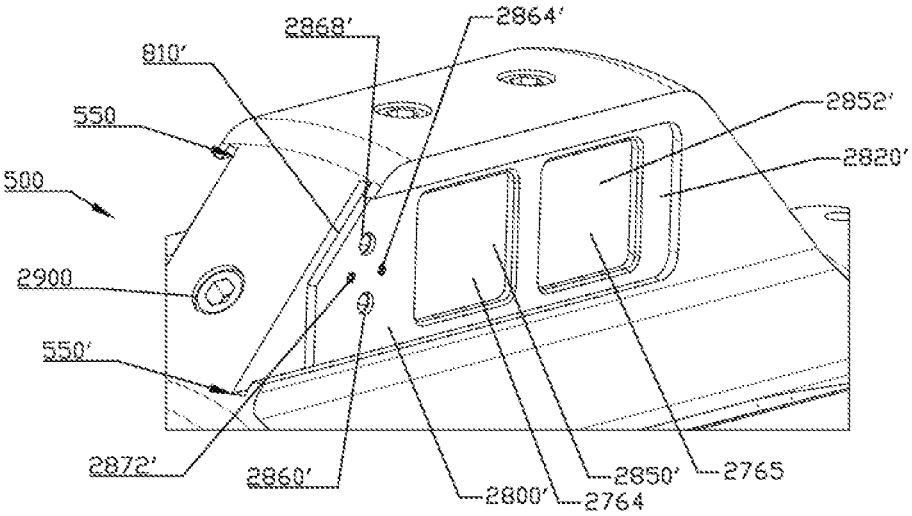
FIG. 38 is an enlarged perspective view of one of the ridge portions of the magnet tool of FIG. 30.

FIG. 36 is an enlarged perspective view of ridge 500 of magnet tool 10' of FIG. 30 shown without magnets, spacers 700, or retaining plate 800. FIG. 37 is an enlarged perspective view of ridge 500 of magnet tool 10' shown without retaining plate 800. FIG. 38 is an enlarged perspective view of ridge 500 of magnet tool 10.

FIG. 36 shows one of the milled openings 650 as cut into the second face 540 of milled ridge 500. Each ridge (e.g., 500, 900, 1000, 1400, and 1420) can have at least one milled opening on each side (e.g., for ridge 500 having first side 530 with opening 600, and second side 540 with opening 650) and not shown first side 530 can have opening 600 which can be identical to opening 650, but mirror images of each other.

In FIG. 37 magnets 2764 and 2765 plus spacer 2700' are inserted into ridge opening 650. Grub screws 562 and 570 and springs for each grub screw are then installed fully, so that the top of the grub screws are flush with the corresponding outer surface of side. Here, bissell pins 566 and 574 are shown only for illustration and are installed later after sliding in of retaining plate 2800' (shown in FIG. 38). In FIG. 38, retaining plate 2800' is then slid into slot 550' from one end (first end 510). The grub screws 562 and 570 align with internal holes 2860' and 2868' of retainer plate 2800'. Each grub screw 562 and 570 is then backed out into the holes 2860' and 2868' and the respective grub screw spring holds its respective grub screw in place (locking retaining plate 2800'). Bissell pins 566 and 574 are then inserted into the holes 564 and 572 as a secondary locking mechanism to prevent removal of retaining plate 2800'.

Figure 39:
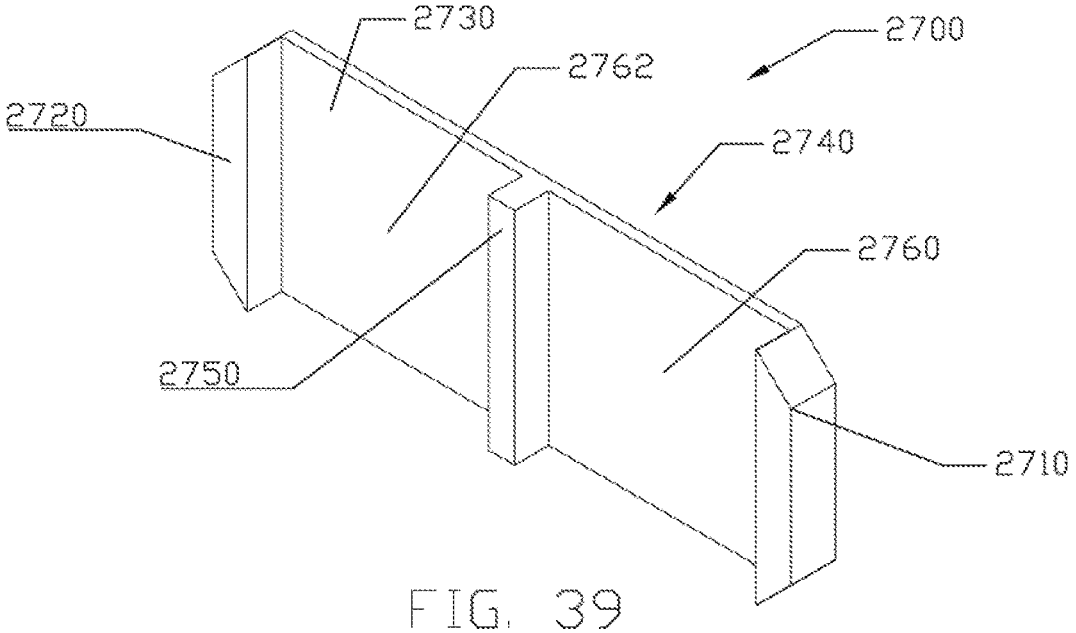
FIG. 39 is a perspective view of a spacer which can be used with the magnet tool shown in FIG. 30.
Figure 40:
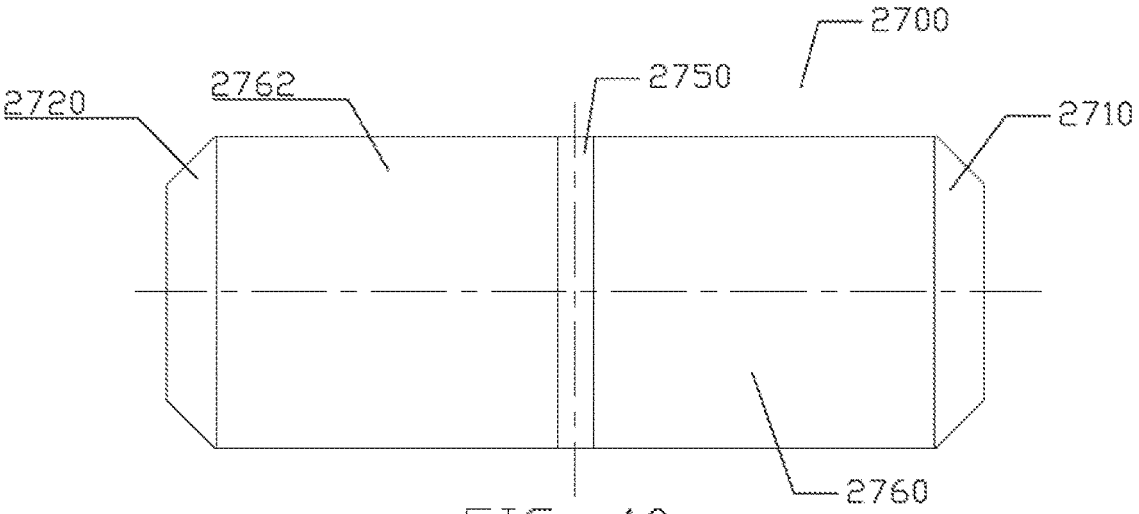
FIG. 40 is a top view of the spacer of FIG. 39.
Figure 41:
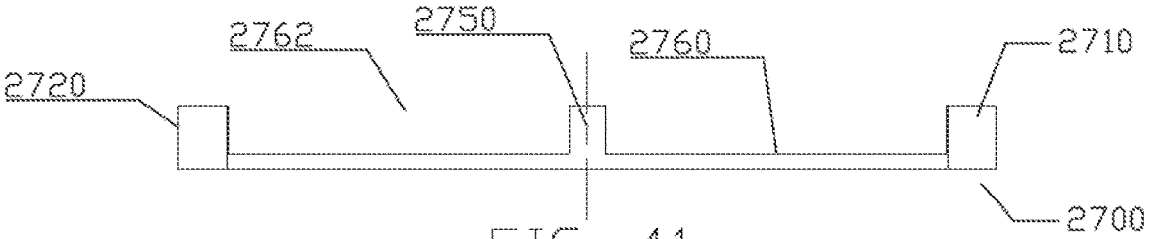
FIG. 41 is side view of the spacer of FIG. 39.

FIG. 39 is a perspective view of a spacer 700 which can be used with magnet tool 10'. FIG. 40 is a top view of spacer 700. FIG. 41 is side view of spacer 700.

Figure 42:
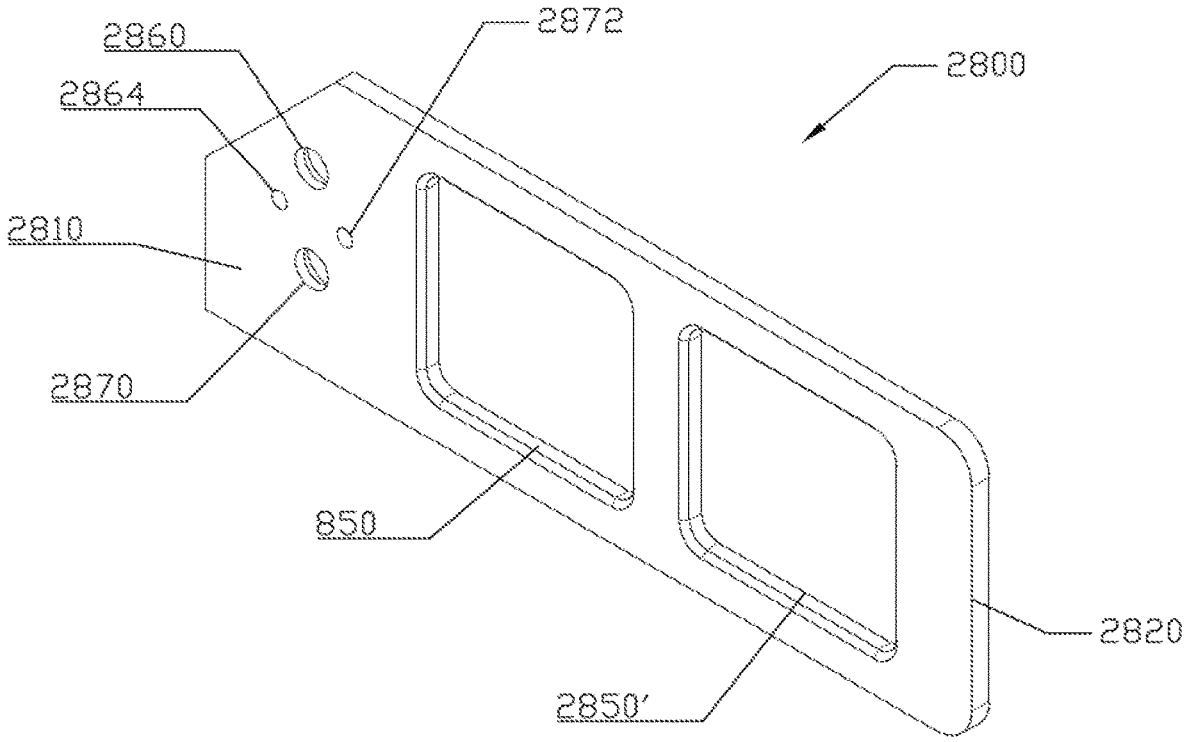
FIG. 42 is a perspective view of a retaining plate which can be used with the magnet tool shown in FIG. 30.

FIG. 42 is a perspective view of a retaining plate 800 which can be used with magnet tool 10'.

In one embodiment the a plurality of nozzle output jetting lines 2900 are provided which are fluidly connected to central bore 130 allowing fluid from the string to both pass through the tool body 100 and exit the end of the drill string, and also through the output lines 2900 to facilitate washing of the well to free debris along with an upward flow of debris and increase the amount of collection of debris on the magnets. Because each ridge (e.g., ridge 500, 900, 1000, 1400, and 1420) can be constructed substantially similar to each other, only one ridge will be discussed below (with it being understood that the remaining ridges are substantially similar and need not be described again).

In one embodiment each longitudinal ridge (e.g., ridge 500) can include a plurality of jetting lines 2900. For example In different embodiments the number of jetting lines (e.g., 2910, 2920, 2930, and 2940) in a ridge (e.g., ridge 500) can be 1, 2, 3, 4, 5, 6, 7, 8, 9, 10, 12, 14, and 15 (with four shown in the figures for simplicity). In various embodiments the number of jetting lines in a ridge can be within a range between any two of the above specified number of jetting lines.

In various embodiments each jetting line in a ridge of the plurality of jetting lines can include a jetting nozzle. In various embodiments nozzles (e.g., 2916, 2926, 2936, and 2946) can be attached to each jetting line (e.g., 2910, 2920, 2930, and 2940), and can be substantially the same size. In various embodiments the nozzles (e.g., 2916, 2926, 2936, and 2946) can be of different sizes. In various embodiments each ridge (e.g., 500, 900, 1400, and 1420) can include a plurality of jetting lines (e.g., 2910, 2920, 2930, and 2940) and the user is provided with the option of selectively closing or shutting off one or more of the jetting lines in such ridge.

In various embodiments the plurality of exits from the plurality of jetting lines in a ridge can create jets of differing angles when compared to the longitudinal centerline 2034 of magnet tool 10'. In various embodiments (e.g., as shown in FIG. 27) at least one of the jets of a ridge can be substantially perpendicular to the longitudinal center line 2034 (e.g., lines 2920' and 2930'), and at least one of the jets of the same ridge can be other than substantially perpendicular to the longitudinal center line 2034 (e.g., lines 2910' and 2940'). In some embodiments at least one jet can be angled towards upper end 2010 of tool 10' (e.g., line 2910'), at least one jet can be substantially perpendicular to longitudinal centerline 2034 (e.g., lines 2920' and 2930'), and at least one jet can be angled towards lower end 2020 (e.g., line 2940').

In various embodiments a plurality of jets of a ridge can be substantially perpendicular to the longitudinal center line 2034 (e.g., lines 2920' and 2930'), and a plurality of the jets of the same ridge can be other than substantially perpendicular to the longitudinal center line 2034 (e.g., lines 2910' and 2940') and at least three of the jets of the same ridge are not parallel to each other (e.g., line 2910' being not parallel with line 2940'; line 2910' being not parallel with line 2920' or line 2930; and line 2940' being not parallel with line 2920' or line 2930'). In various embodiments the non-parallel lines can be angled from the longitudinal centerline 2034 by 15, 20, 25, 30, 40, 45, 50, 55, 60, 65, 70, and 75 degrees. In various embodiments the non-perpendicular lines can be within a range between any two of the above specified degree measurements.

In various embodiments the plurality of jets for a particular longitudinal ridge can exit from the ride at a point which is between the two sets of magnets on either face of the ridge. For example, in ridge 500 plurality of jets 2910, 2920, 2930, and 2940 exit between sides 510 and 520 of ridge 500. In various embodiments the plurality of jets 2910, 2920, 2930, and 2940 exit between spaced apart on either side of the ridge (e.g., jets 2910, 2920, 2930, and 2940 exit between magnets in opening 600 on first side 530 and opening 650 on second side 600 of ridge 500).

Jetting and Magnetized Pickup Operations

Figure 57:
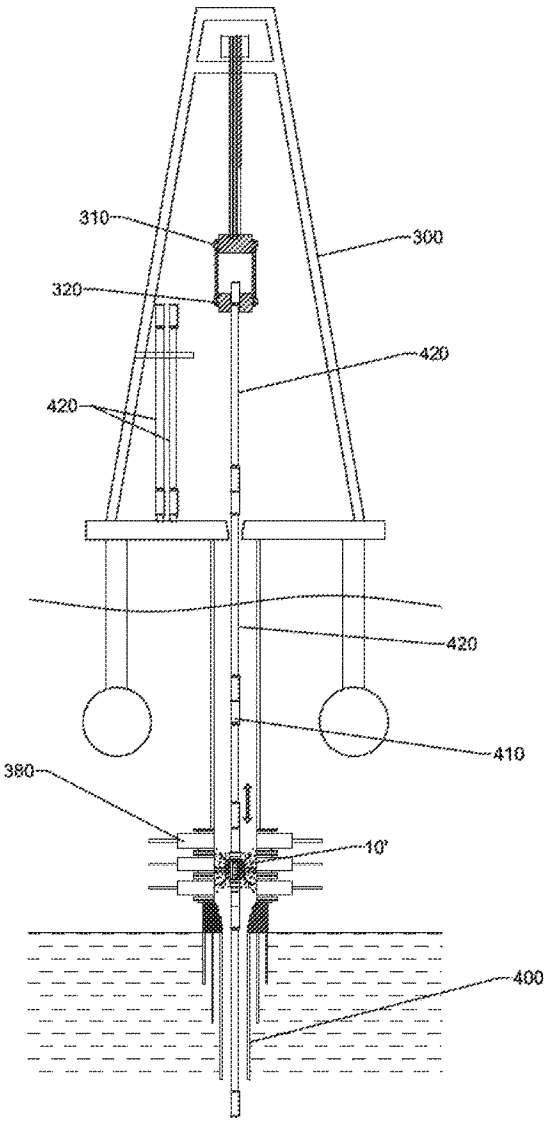
FIG. 57 is a schematic view of the tool assembly 10' jetting a ram blowout preventer with its plurality of magnets catching magnetic debris around the jetting area.
Figure 58:
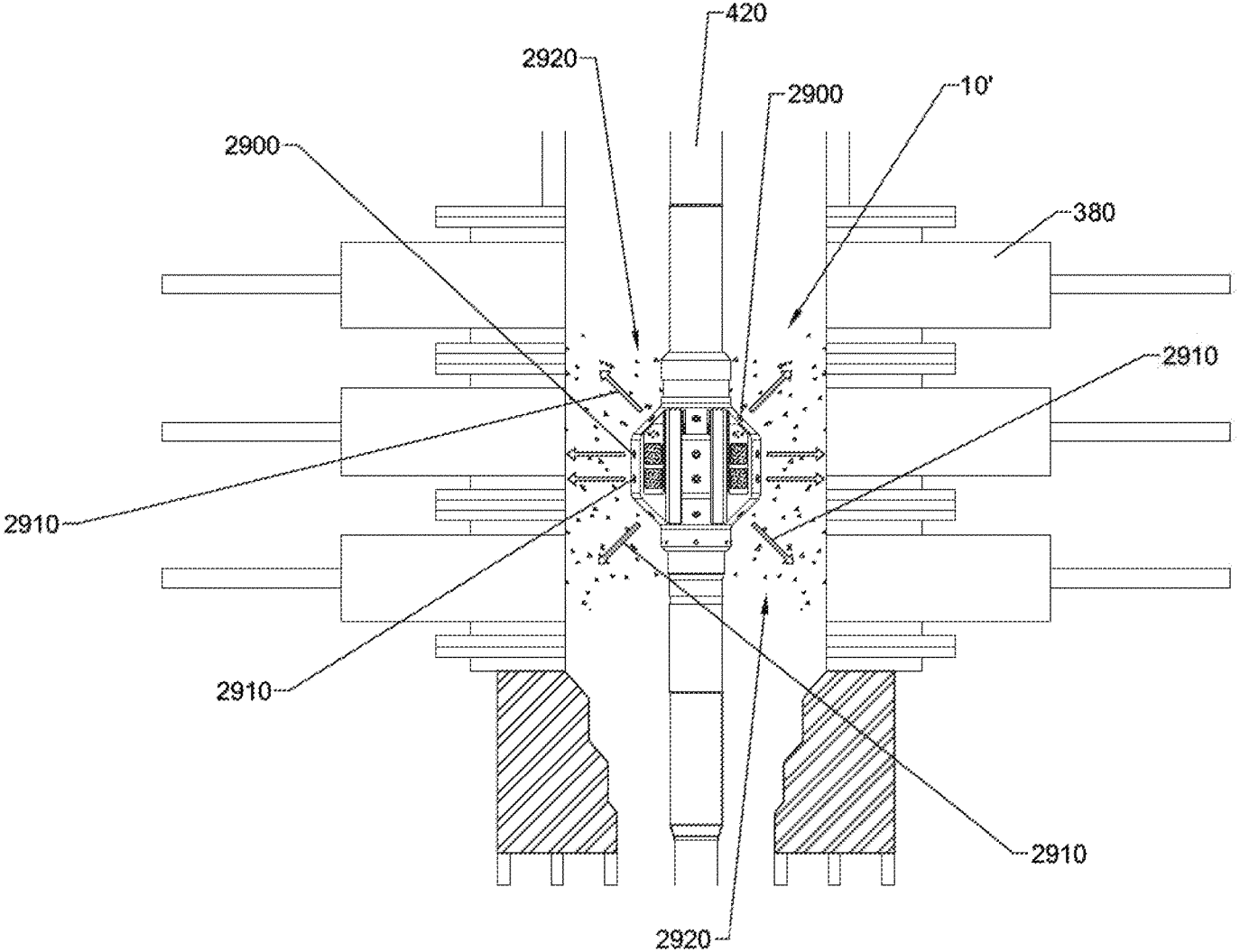
FIG. 58 is an enlarged schematic view of the tool assembly 10' shown in FIG. 57.

FIG. 57 is a schematic view of the tool assembly 10' jetting a ram blowout preventer 380 with its plurality of magnets catching magnetic debris around the jetting area. Derrick 300 is shown with block 310 and elevator 320 supporting drill pipe 410 which is comprised of joints 420 of drill pipe. FIG. 58 is an enlarged schematic view of tool assembly 10'.

Tool assembly 10' is supported by drill pipe 410 and located inside of blow out preventer 380. Tool assembly is shown as having jetting ports 2900 which are being used to jet or spray out fluid in the area of blow out preventer 380. Arrows 2910 schematically indicate streams of jetted out fluid. Such jet streams create an area of mixing 2920 wherein debris can be cleaned from the walls and movement of particles can be cause. Such movement of particles allow magnetic particles which come within the magnetic field lines created by the plurality of magnets in the ridges to be pulled towards and captured by the magnets creating the magnetic fields.

Figure 59:
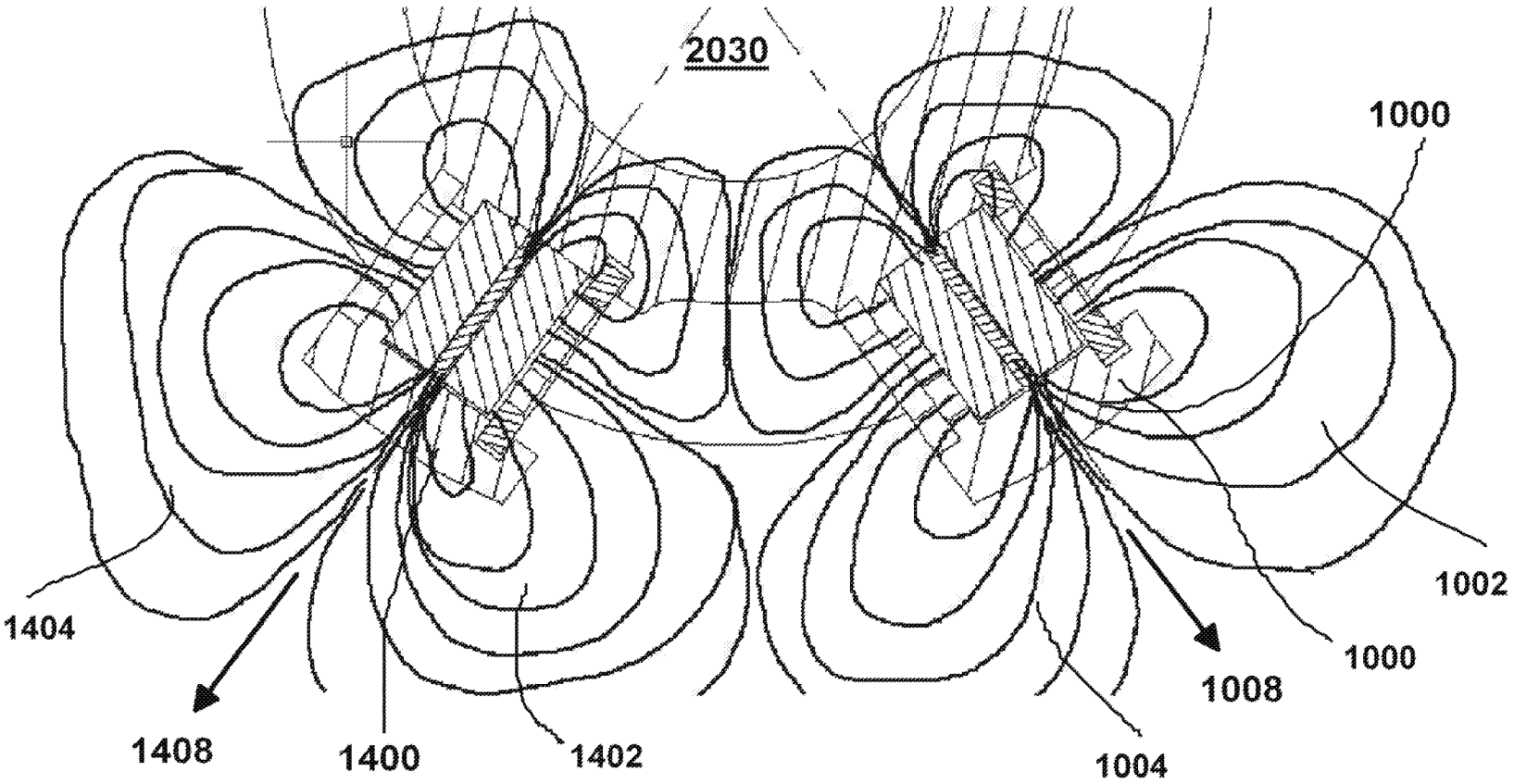
FIG. 59 is a schematic view of the magnetic field created by some of the plurality of magnets in the five magnetized ridges of the tool assembly of FIG. 1.

FIG. 59 is a schematic view of representative magnetic field created by the plurality of magnets in two of the five magnetized ridges of the tool assembly 10 (ridges 1000 and 1400). Each side of each ridge has its own set of spaced apart magnets which create a magnetic field. In FIG. 59 ridge 1000 is shown having magnetic fields 1002 and 1004. Similarly, ridge 1400 is shown having magnetic fields 1402 and 1404.

Figure 60:
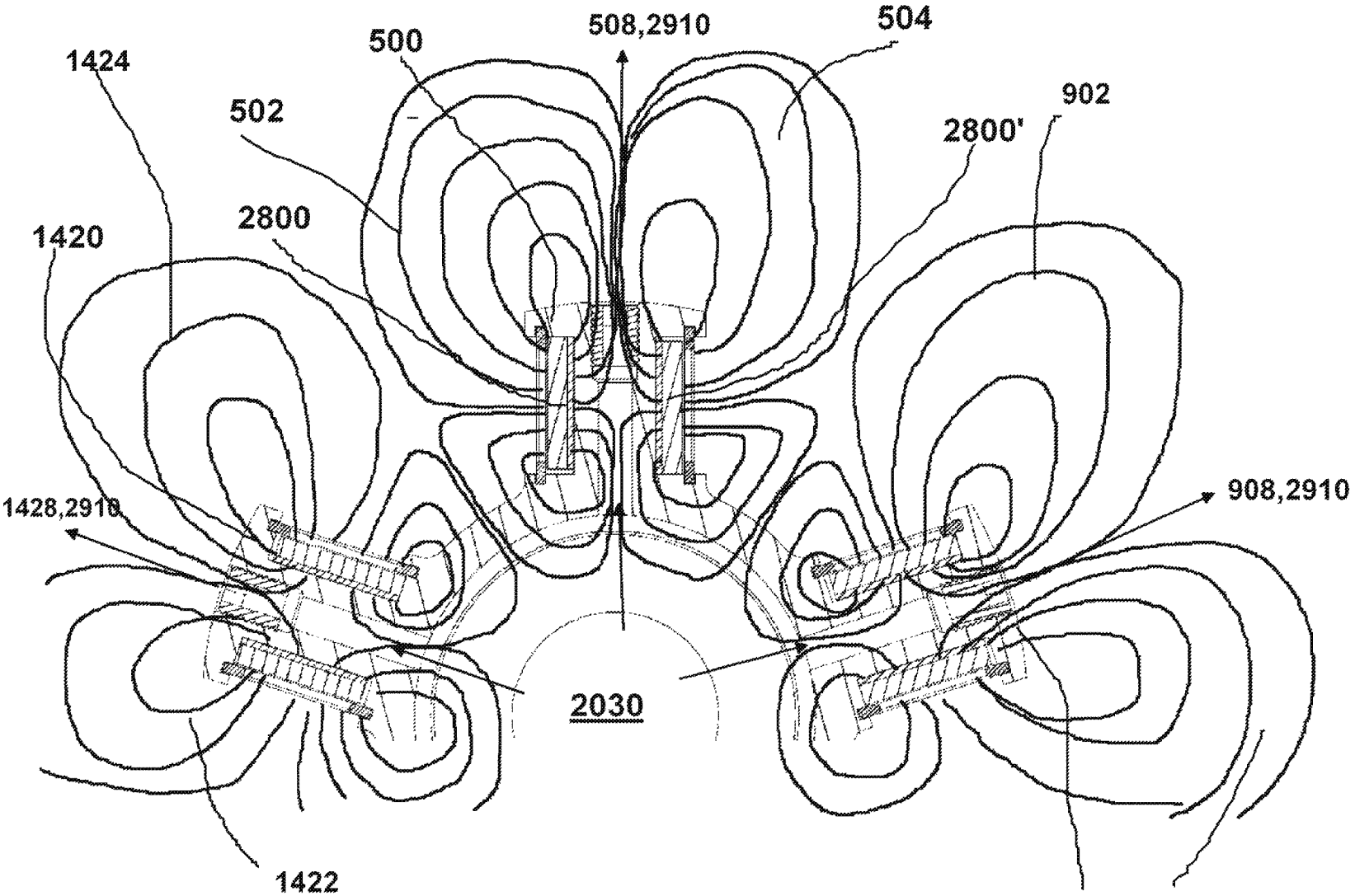
FIG. 60 is a schematic view of the magnetic field created by some of the plurality of magnets in the five magnetized ridges of the tool assembly of FIG. 57.

FIG. 60 is a schematic view of the magnetic field created by some of the plurality of magnets in three the five magnetized ridges of the tool assembly 10' (ridges 500, 900, and 1420). Each side of each ridge has its own set of spaced apart magnets which create a magnetic field. In FIG. 60 ridge 500 is shown having magnetic fields 502 and 504. Similarly, ridge 900 is shown having magnetic fields 902 and 904. Similarly, ridge 1420 is shown having magnetic fields 1422 and 1424. In FIG. 60 is shown the option of including on each ridge jetting (schematically indicated by arrows 2910) can occur at the center of the two magnetic fields and in a radial direction which is between the two faces of the ridge and between the opposed sets of magnetized elements in recesses in each face of the ridge. Such direction and location of jetting can assist in accumulation of ferromagnetic debris as such particles can tend to flow along pathways which tend to trace the magnetic field lines and end up on one of the faces of the plurality of magnets.

Having jet nozzles 2900 between sets of magnets on the plurality of ridges assist is believed to assist in the collection of debris when compared to no jetting or jetting above and below the magnets. Jet nozzle placement is believe to assist with ferrous metal attraction as the jet stream from a jet nozzle will induce movement of fluid from behind the stream and create eddy currents which tend to cause debris to flow along magnetic field lines and end up captured on one of the faces of the plurality of magnets thereby exposing more suspended debris to the magnetic fields.

Different directions of jetting nozzles can also assist in dislodging debris from the well bore such as from blow out preventers. Having different angles of jetting nozzles assists in the dislodgment process as debris is jetted from different angles.

Detachable Sleeve With Magnetized Valleys and Jetting Ports In Ridges

Figure 61:
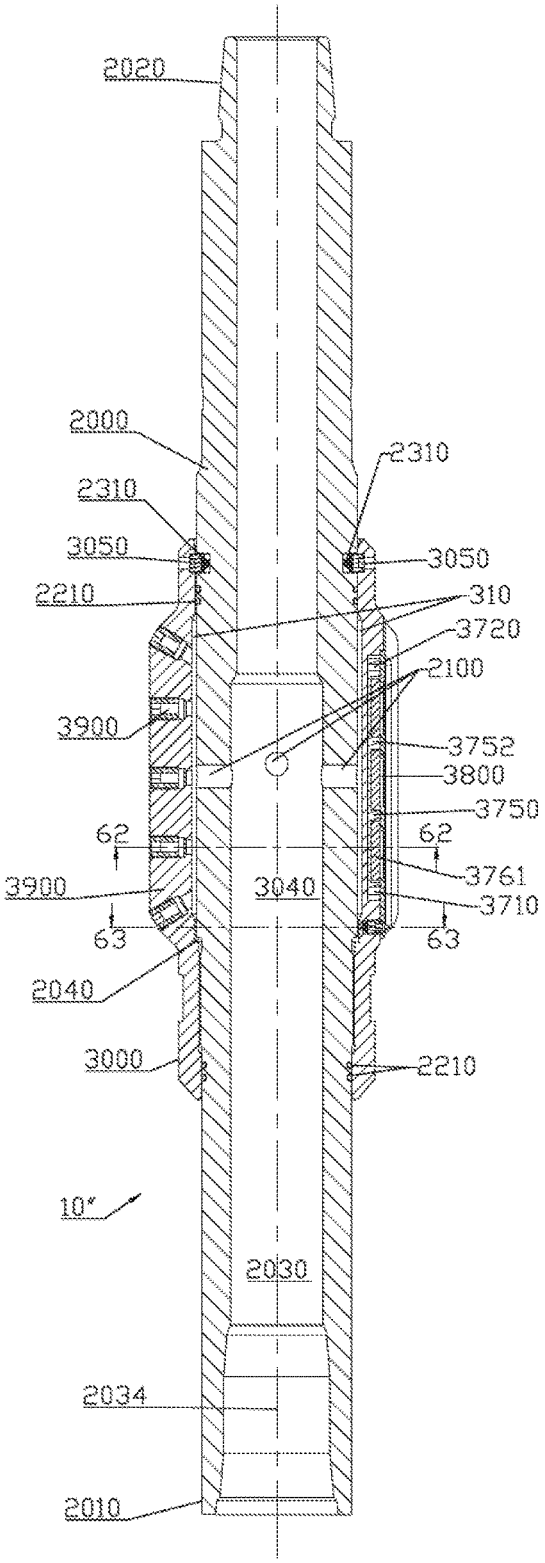
FIG. 61 is a sectional of a third embodiment of a magnet tool having magnets in valleys between longitudinal ridges in a jetting sleeve where the sleeve is removable from the tool mandrel.

FIG. 61 is a sectional of a third embodiment of a magnet tool 10" having magnets in valleys between longitudinal ridges (e.g., ridges 500, 900, 1000, 1400, and 1420) in a jetting sleeve 3000 where the sleeve is removable from the tool mandrel 2000.

Figure 63:
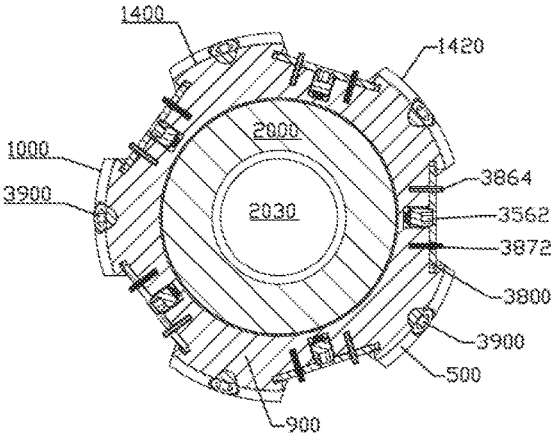
FIG. 63 is a sectional view of the magnet tool of FIG. 61 taken from section line 63--63 shown in FIG. 61.
Figure 62:
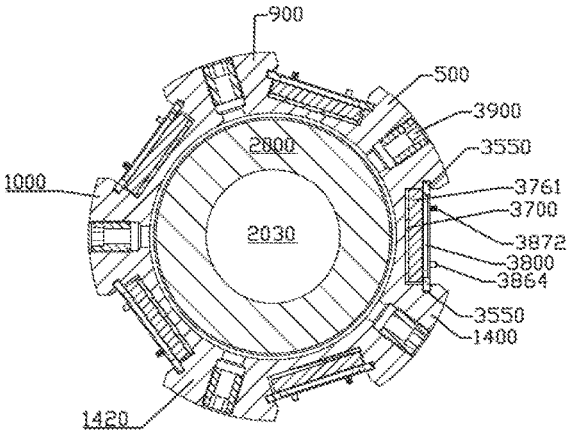
FIG. 62 is a sectional view of the magnet tool of FIG. 61 taken from section line 62--62 shown in FIG. 61.

FIG. 62 is a sectional view of magnet tool 10" taken from section line 62--62 shown in FIG. 61. FIG. 63 is a sectional view of magnet tool 10" taken from section line 63--63 shown in FIG. 61.

Figure 64:
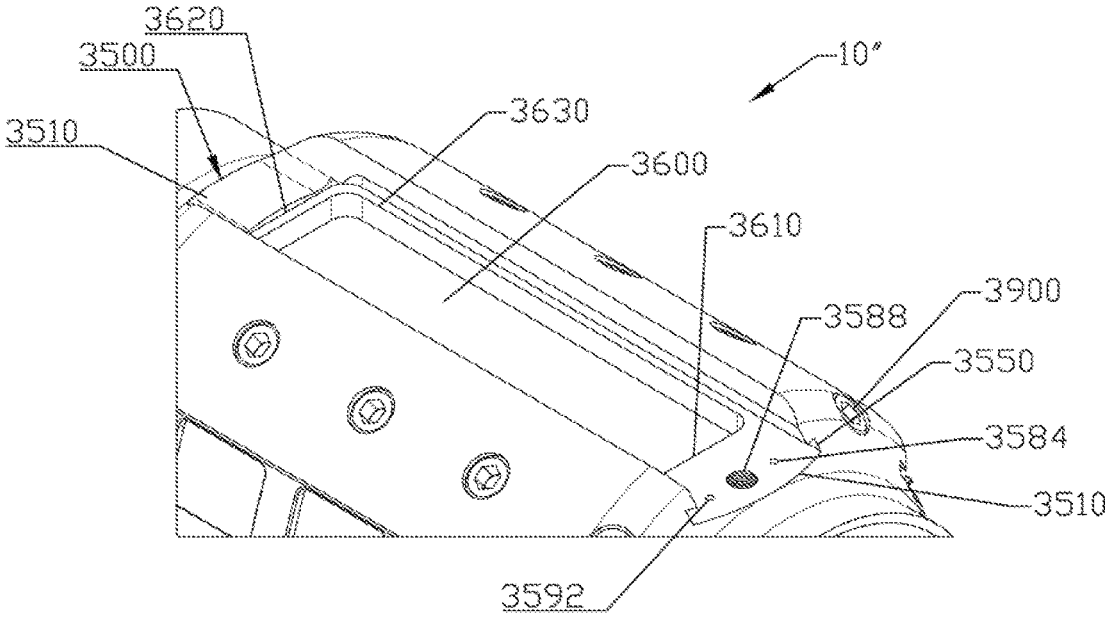
FIG. 64 is a side perspective view of the sleeve portion of the magnet tool of FIG. 61 shown without magnets, spacers, and retaining plates.

FIG. 64 is a side perspective view of sleeve 3000 of magnet tool 10" shown without magnets, spacers, and retaining plates.

Figure 65:
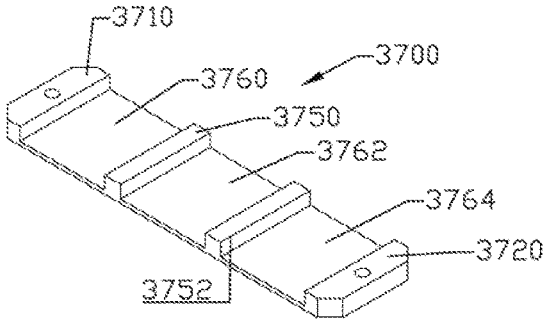
FIG. 65 is a perspective view of a spacer which can be used with the magnet tool shown in FIG. 61.

FIG. 65 is a perspective view of a spacer 3700 which can be used with magnet tool 10".

Figure 66:
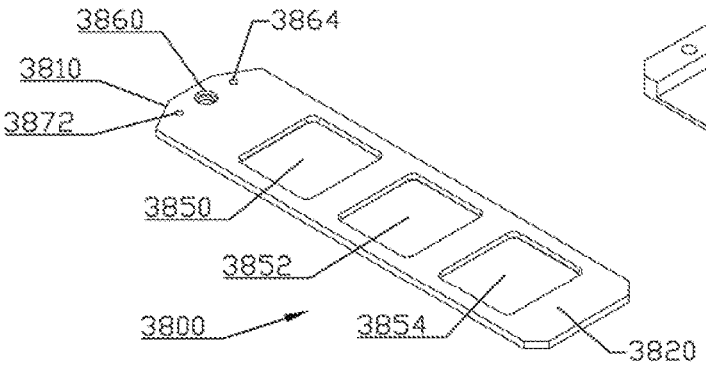
FIG. 66 is a perspective view of a retaining plate which can be used with the magnet tool shown in FIG. 61.

FIG. 66 is a perspective view of a retaining plate 3800 which can be used with magnet tool 10".

Figure 67:
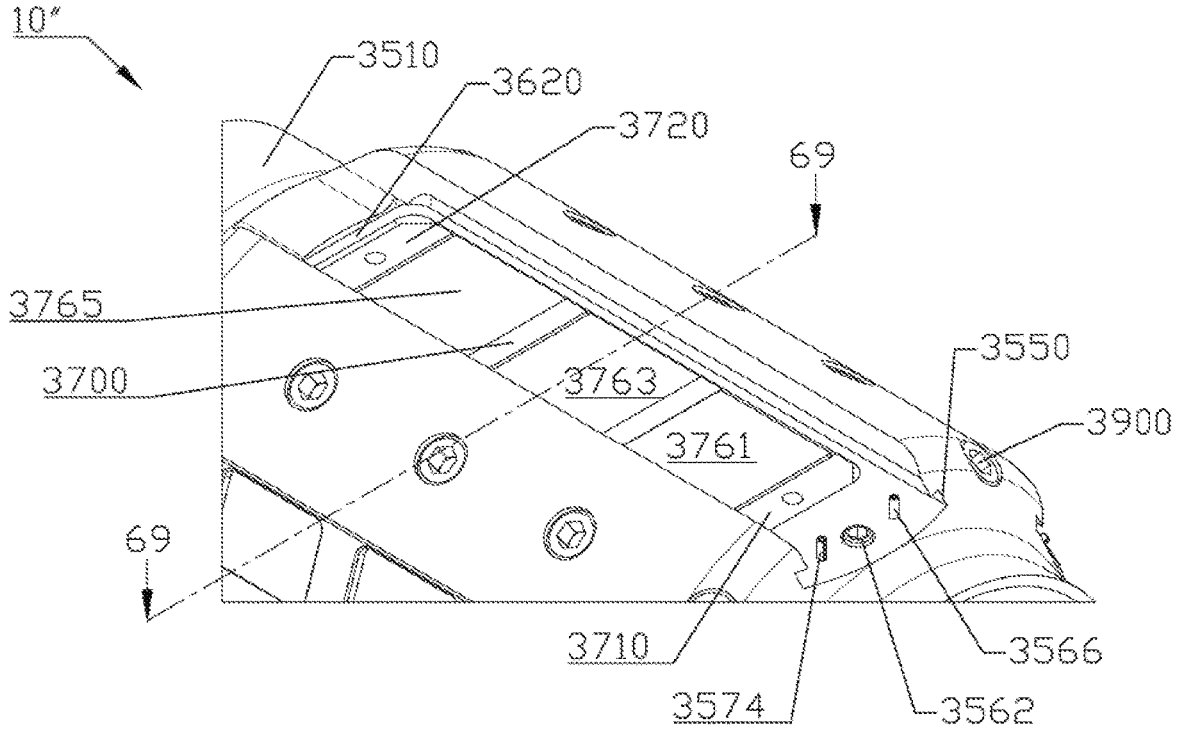
FIG. 67 is a side perspective view of the sleeve portion of the magnet tool of FIG. 61 shown without retaining plate.
Figure 68:
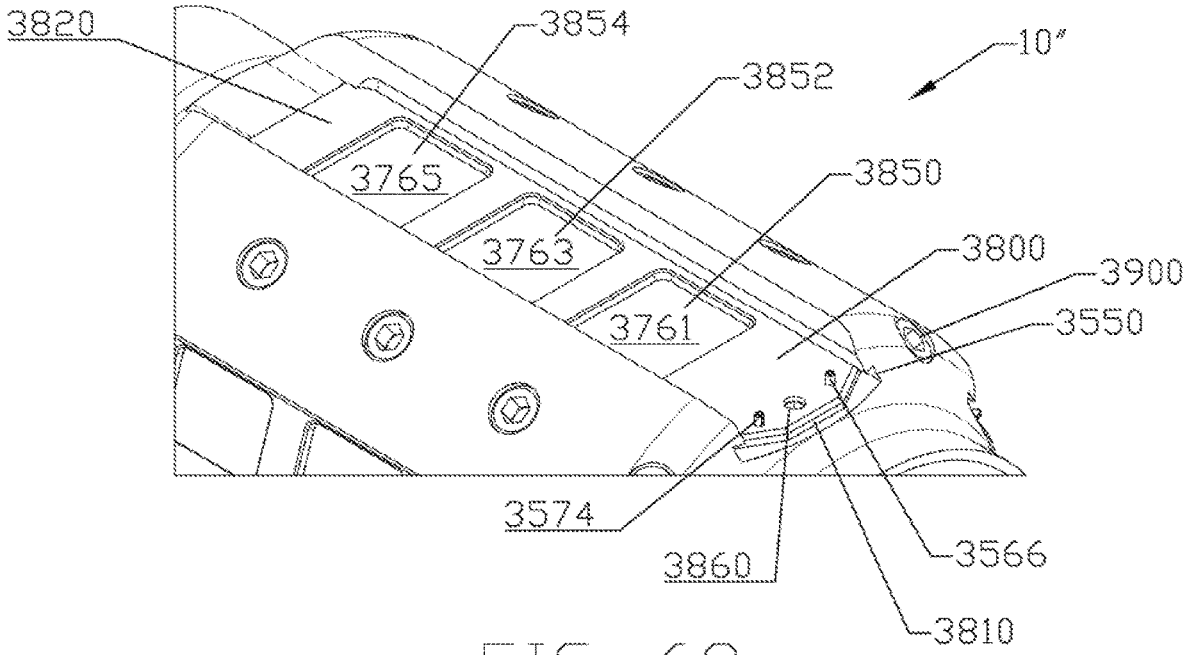
FIG. 68 is a side perspective view of the sleeve portion of the magnet tool of FIG. 61.
Figure 69:
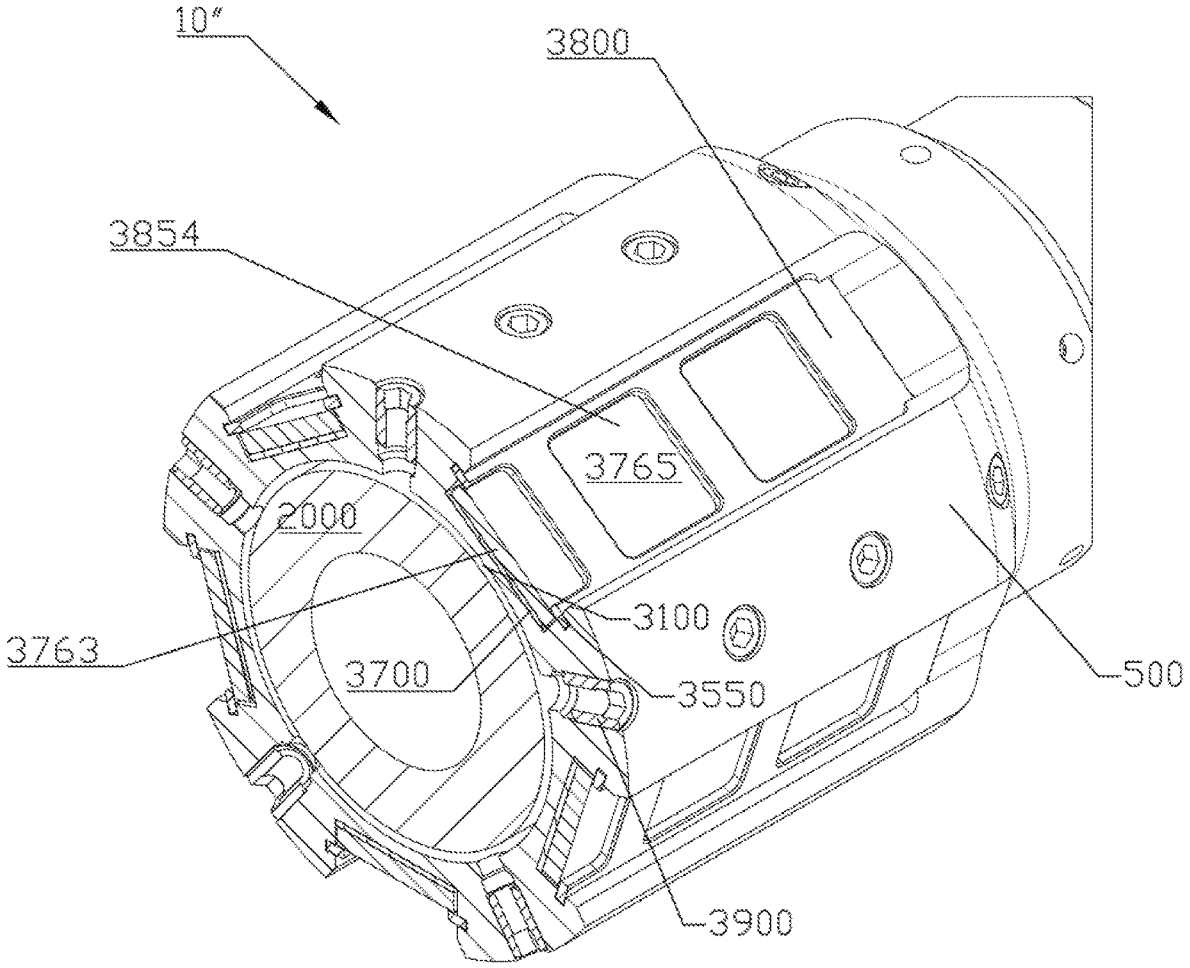
FIG. 69 is a sectional view of the magnet tool of FIG. 61 taken from section line 69--69 shown in FIG. 68.

FIG. 67 is a side perspective view of sleeve 3000 of magnet tool 10" shown without retaining plate 3800. FIG. 68 is a side perspective view of sleeve 3000 of magnet tool 10". FIG. 69 is a sectional view of magnet tool 10" taken from section line 69--69 shown in FIG. 67.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alternations and modifications, including but not limited to those design alternatives specifically discussed herein, may be made in the practice of the invention without departing from its scope.

The following is a list of Reference Numerals used in the present invention:

LIST OF REFERENCE NUMERALS

| REFERENCE NUMBER | DESCRIPTION |
|---|---|
| 10 | tool assembly |
| 100 | elongate tool body |
| 110 | upper box end |
| 120 | lower pin end |
| 130 | central bore |
| 134 | longitudinal axis |
| 200 | plurality of longitudinal ridges |
| 300 | derrick |
| 310 | block |
| 320 | elevator |
| 330 | tugger line |
| 380 | BOP (ram type) |
| 400 | wellbore |
| 410 | drill string |
| 420 | drill pipe joint/section |
| 450 | arrow |
| 452 | arrow |
| 454 | arrow |
| 456 | arrow |
| 458 | arrow |
| 460 | arrow |
| 500 | first ridge |
| 502 | side of magnetic field lines |
| 504 | side of magnetic field lines |
| 508 | radial line |
| 510 | first end of first ridge |
| 520 | second end of first ridge |
| 530 | first side of first ridge |
| 532 | arrow |
| 540 | second side of first ridge |
| 550 | slot for first ridge |
| 560 | locking opening for grub screw |
| 562 | grub screw |
| 564 | locking opening for bissel pin |
| 566 | bissel pin |
| 568 | locking opening for grub screw |
| 570 | grub screw |
| 572 | locking opening for bissel pin |
| 574 | bissel pin |
| 580 | locking opening for grub screw |
| 582 | grub screw |
| 584 | locking opening for bissel pin |
| 586 | bissel pin |
| 588 | locking opening for grub screw |
| 590 | grub screw |
| 592 | locking opening for bissel pin |
| 594 | bissel pin |
| 600 | first opening, pocket, or recess |
| 610 | first side of first opening |
| 620 | second side of first opening |
| 630 | side walls of first opening, pocket, or recess |
| 640 | reduced area of first opening |
| 650 | second opening, pocket, or recess |
| 660 | first side of second opening |
| 670 | second side of second opening |
| 680 | side walls of second opening, pocket, or recess |
| 690 | reduced area of second opening |
| 700 | spacer |
| 710 | first end |
| 720 | second end |
| 730 | first side |
| 740 | second side |
| 750 | middle portion |
| 760 | first recessed area |
| 761 | first magnet |
| 762 | second recessed area |
| 763 | second magnet |
| 764 | third recessed area |
| 765 | third magnet |

-continued

| REFERENCE NUMBER | DESCRIPTION |
|---|---|
| 766 | fourth recessed area |
| 767 | fourth magnet |
| 770 | first end |
| 771 | second end |
| 772 | top |
| 773 | bottom |
| 774 | first face |
| 775 | second face |
| 800 | retaining plate |
| 810 | first end |
| 820 | second end |
| 830 | first side |
| 840 | second side |
| 850 | opening for magnet |
| 852 | opening for magnet |
| 860 | locking opening for grub screw |
| 864 | locking opening for bissel pin |
| 868 | locking opening for grub screw |
| 872 | locking opening for bissel pin |
| 900 | second ridge |
| 902 | side of magnetic field lines |
| 904 | side of magnetic field lines |
| 1000 | third ridge |
| 1002 | side of magnetic field lines |
| 1004 | side of magnetic field lines |
| 1008 | radial line |
| 1010 | first end of third ridge |
| 1020 | second end of third ridge |
| 1030 | first side of third ridge |
| 1040 | second side of third ridge |
| 1050 | slot for third ridge |
| 1060 | locking opening for grub screw |
| 1062 | grub screw |
| 1064 | locking opening for bissel pin |
| 1066 | bissel pin |
| 1068 | locking opening for grub screw |
| 1070 | grub screw |
| 1072 | locking opening for bissel pin |
| 1074 | bissel pin |
| 1100 | first opening, pocket, or recess |
| 1110 | first side of first opening |
| 1120 | second side of first opening |
| 1130 | side walls of first opening, pocket, or recess |
| 1140 | reduced area of first opening |
| 1150 | second opening, pocket, or recess |
| 1160 | first side of second opening |
| 1170 | second side of second opening |
| 1180 | side walls of second opening, pocket, or recess |
| 1190 | reduced area of second opening |
| 1200 | spacer |
| 1210 | first end |
| 1220 | second end |
| 1230 | first side |
| 1240 | second side |
| 1250 | middle portion |
| 1260 | first recessed area |
| 1261 | first magnet |
| 1262 | second recessed area |
| 1263 | second magnet |
| 1264 | third recessed area |
| 1265 | third magnet |
| 1266 | fourth recessed area |
| 1267 | fourth magnet |
| 1300 | retaining plate |
| 1310 | first end |
| 1320 | second end |
| 1330 | first side |
| 1340 | second side |
| 1350 | opening for magnet |
| 1360 | locking opening for grub screw |
| 1362 | grub screw |
| 1364 | locking opening for bissel pin |
| 1366 | bissel pin |
| 1368 | locking opening for grub screw |

-continued

| REFERENCE NUMBER | DESCRIPTION |
|---|---|
| 1370 | grub screw |
| 1372 | locking opening for bissel pin |
| 1374 | bissel pin |
| 1390 | radial line |
| 1400 | fourth ridge |
| 1402 | side of magnetic field lines |
| 1404 | side of magnetic field lines |
| 1408 | radial line |
| 1420 | fifth ridge |
| 1422 | side of magnetic field lines |
| 1424 | side of magnetic field lines |
| 1428 | radial line |
| 2000 | mandrel |
| 2010 | first end |
| 2020 | second end |
| 2030 | longitudinal bore |
| 2034 | longitudinal center line |
| 2040 | shoulder |
| 2100 | plurality of radial ports |
| 2200 | O-rings |
| 2210 | radial slots for O-rings |
| 2300 | plurality of openings for grub screws |
| 2310 | plurality of grub screws |
| 2312 | plurality of springs for grub screws |
| 2350 | threaded area |
| 2500 | sleeve |
| 2510 | first end |
| 2520 | second end |
| 2530 | longitudinal bore |
| 2540 | shoulder |
| 2550 | plurality of grub screw openings |
| 2600 | annular area |
| 2700 | spacer |
| 2710 | first end |
| 2720 | second end |
| 2730 | first side |
| 2740 | second side |
| 2750 | middle portion |
| 2760 | first recessed area |
| 2761 | first magnet |
| 2762 | second recessed area |
| 2763 | second magnet |
| 2764 | third magnet |
| 2765 | fourth magnet |
| 2800 | retaining plate |
| 2810 | first end |
| 2820 | second end |
| 2830 | first side |
| 2840 | second side |
| 2850 | opening for magnet |
| 2852 | opening for magnet |
| 2854 | opening for magnet |
| 2860 | locking opening for grub screw |
| 2864 | locking opening for bissel pin |
| 2870 | locking opening for grub screw |
| 2872 | locking opening for bissel pin |
| 2900 | plurality of nozzle outputs lines |
| 2910 | direction of jetted flow |
| 2920 | combination of moving fluid, debris, and ferromagnetic materials |
| 3000 | sleeve |
| 3010 | first end |
| 3020 | second end |
| 3030 | longitudinal bore |
| 3040 | shoulder |
| 3050 | plurality of grub screw openings |
| 3100 | annular area |
| 3200 | plurality of nozzle outputs lines |
| 3500 | first valley |
| 3510 | first end of first valley |
| 3520 | second end of first valley |
| 3530 | first side of first valley |
| 3532 | arrow |
| 3540 | second side of first valley |
| 3550 | slot for first valley |
| 3560 | locking opening for grub screw |

-continued

| REFERENCE NUMBER | DESCRIPTION |
|---|---|
| 3562 | grub screw |
| 3564 | locking opening for bissel pin |
| 3566 | bissel pin |
| 3572 | locking opening for bissel pin |
| 3574 | bissel pin |
| 3580 | locking opening for grub screw |
| 3582 | grub screw |
| 3584 | locking opening for bissel pin |
| 3586 | bissel pin |
| 3588 | locking opening for grub screw |
| 3590 | grub screw |
| 3592 | locking opening for bissel pin |
| 3594 | bissel pin |
| 3600 | first opening, pocket, or recess |
| 3610 | first side of first opening |
| 3620 | second side of first opening |
| 3630 | side walls of first opening, pocket, or recess |
| 3650 | second opening, pocket, or recess |
| 3660 | first side of second opening |
| 3670 | second side of second opening |
| 3680 | side walls of second opening, pocket, or recess |
| 3690 | reduced area of second opening |
| 3700 | spacer |
| 3710 | first end |
| 3720 | second end |
| 3730 | first side |
| 3740 | second side |
| 3750 | first middle portion |
| 3752 | second middle portion |
| 3760 | first recessed area |
| 3761 | first magnet |
| 3762 | second recessed area |
| 3763 | second magnet |
| 3764 | third recessed area |
| 3765 | third magnet |
| 3800 | retaining plate |
| 3810 | first end |
| 3820 | second end |
| 3830 | first side |
| 3840 | second side |
| 3850 | opening for magnet |
| 3852 | opening for magnet |
| 3854 | opening for magnet |
| 3860 | locking opening for grub screw |
| 3864 | locking opening for bissel pin |
| 3872 | locking opening for bissel pin |
| 3900 | plurality of nozzle outputs lines |

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. A magnet tool for use in removing ferrous material from a wellbore, the tool comprising:
an elongated tool body, the tool body having
first and second ends;
a longitudinal axis; and
a through bore extending from the first to second end;
a plurality of circumferentially spaced apart longitudinal ridges with gaps between each pair of said ridges,
each ridge being in the form of
a flange projecting radially from the longitudinal axis; and
being aligned with the longitudinal axis,
the flange having
spaced apart first and second radially extending surface areas and
an outer surface spaced away from the longitudinal axis and
that extends
from the first radially extending surface area
to the second radially extending surface area;
wherein each of the flanges includes
at least one magnetic element
detachably mounted in a spaced apart configurations,
wherein each of said at least one magnetic element is
detachably held in place by a retaining plate,
the retaining plate having an area exposing to an exterior surface
at least a portion of the at least one magnetic elements.

2. The magnet tool of claim 1, wherein between the plurality of longitudinal flanges are collection areas for ferromagnetic debris.

3. The magnet tool of claim 1, wherein each of the radially projecting ridges includes a radial slot, and the at least one magnetic element is detachably held in place by said removable retaining plate slidably inserted in the slot, and the slot is located in a plane that is parallel to the longitudinal axis.

4. The magnet tool of claim 1, wherein at least one opening is provided in each flange at a said radially extending surface area to mount a plurality of spaced apart magnetic elements therein.

5. The magnet tool of claim 1, wherein each of said at least one magnet includes a plurality of magnetic elements which are spaced apart in their respective longitudinal ridge by a spacer.

6. The magnet tool of claim 5, wherein the spacer is comprised of a non- magnetic material.

7. The magnet tool of claim 6, wherein the spacer magnetically isolates from each other at least two of the magnets spaced apart by the spacer.

8. The magnet tool of claim 1, wherein each of the longitudinal ridges includes first and second faces and an opening extending from the first to second face, and the magnetic element is inserted into the opening.

9. The magnet tool of claim 1, wherein the tool body comprises first and second sections which are detachably connected together, and the second section includes the plurality of longitudinal ridges.

10. A method of cleaning debris in a wellbore comprising the steps of:
(a) providing a magnet tool comprising:
an elongated tool body,
the tool body having
first and second ends;
a longitudinal axis; and
a through bore extending from the first to second end;
a plurality of circumferentially spaced apart longitudinal ridges with
an extending gap in between each pair of said ridges
each said ridge
projecting radially from the longitudinal axis and
being aligned with the longitudinal axis, and
each of the longitudinal ridges having at least one longitudinally extending face each of the at least one longitudinally extending face having extending openings opening to at least one of the at least longitudinally extending face for said ridge;

(b) for each of the plurality of longitudinal ridges inserting at least one magnet through the opening in the at least one longitudinally extending face for said ridge;

(c) for each of the plurality of longitudinal ridges locking in place each of said inserted at least one magnet in its respective extending openings by sliding in place a locking retainer plate in the longitudinal ridge, each of the locking retainer plate having openings to expose at least part of the outwardly oriented faces of the magnets inserted in step "b"; and (d) after step "c" inserting the magnet tool into a well bore and collecting debris in said gaps which is magnetically attracted to the magnets of step "b".

11. The method of claim 10, wherein in step "c" each retaining plate is slid in a direction parallel to the longitudinal axis.

12. The method of claim 10, wherein in step "a" the extending openings extend between and through a pair of opposed faces.

13. The method of claim 10, wherein in step "a" the extending openings do not extend between and through a pair of opposed faces, and a pair of opposed retaining plates are slidably locked in place on each face of the pair of opposed faces of the longitudinal ridge.

14. The method of claim 10, wherein in step "b" the north and south poles of each of said at least one inserted magnet are oriented substantially perpendicular to at least one radial line intersecting both the respective longitudinal ridge and the longitudinal axis.

15. The method of claim 14, wherein the magnetic fields of magnets in adjacent longitudinal ridges overlap each other.

16. The method of claim 10, wherein each of the respective plurality of ridges include respective first and second faces, which respective first and second faces are substantially parallel to each other along with a radial line extending from of the longitudinal axis of the through bore between the respective first and second faces and out the top of the ridge, the respective first and second face having respective recesses which extend from their respective opposing faces to a base portion of the respective recess, and between the base portions of opposing recesses being a gap wherein at least one nozzle line extending through the gap which nozzle line being fluidly connected to the through bore, and exiting the respective ridge from the top of the ridge.

17. The method of claim 10, wherein in step "a" the tool body comprises a sleeve detachably connectable to a mandrel, and the plurality of longitudinal ridges are included on the sleeve.

18. The method of claim 17, wherein the sleeve is connected on the mandrel by sliding the sleeve longitudinally along the mandrel.

19. The method of claim 18, wherein the sleeve has an inner shoulder and the mandrel has an outer shoulder, and sliding movement of the sleeve relative to the mandrel is restricted by the sleeve shoulder contacting the mandrel shoulder.

* * * * *